US009972886B2

(12) United States Patent
Petropoulos

(10) Patent No.: US 9,972,886 B2
(45) **Date of Patent: *May 15, 2018**

(54) ANTENNA ASSEMBLIES

(71) Applicant: Laird Technologies, Inc., Earth City, MO (US)

(72) Inventor: Athanasios Petropoulos, Hudson, NH (US)

(73) Assignee: Laird Technologies, Inc., Earth City, MO (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/124,996

(22) PCT Filed: Aug. 25, 2014

(86) PCT No.: PCT/US2014/052550
§ 371 (c)(1),
(2) Date: Sep. 9, 2016

(87) PCT Pub. No.: WO2015/147906
PCT Pub. Date: Oct. 1, 2015

(65) Prior Publication Data

US 2017/0222300 A1 Aug. 3, 2017

Related U.S. Application Data

(63) Continuation of application No. 14/227,710, filed on Mar. 27, 2014, now Pat. No. 9,331,390.
(Continued)

(51) Int. Cl.
*H01Q 1/12* (2006.01)
*H01Q 1/22* (2006.01)
(Continued)

(52) U.S. Cl.
CPC ..... *H01Q 1/2291* (2013.01); *H01Q 1/246* (2013.01); *H01Q 1/42* (2013.01); *H01Q 1/48* (2013.01);
(Continued)

(58) Field of Classification Search
CPC ..... H01Q 1/2291; H01Q 1/246; H01Q 5/30; H01Q 1/42; H01Q 1/48; H01Q 9/285; H01Q 21/062
(Continued)

(56) References Cited

U.S. PATENT DOCUMENTS 4,071,846 A * 1/1978 Oltman, Jr. ..... H01Q 9/065 343/700 MS
4,943,811 A * 7/1990 Alden ..... H01Q 1/248 343/814
(Continued)

FOREIGN PATENT DOCUMENTS

CN 1387282 A 12/2002
CN 203103499 U 7/2013
(Continued)

OTHER PUBLICATIONS

International Search Report and Written Opinion dated Nov. 27, 2014 for PCT International Application No. PCT/US2014/052550 filed Aug. 25, 2014 whichclaims priority to the same parent application as the instant application; 7 pages.
(Continued)

*Primary Examiner* — Dameon E Levi
*Assistant Examiner* — Ab Salam Alkassim, Jr.
(74) *Attorney, Agent, or Firm* — Harness, Dickey & Pierce, P.L.C.

(57) ABSTRACT

According to various aspects, exemplary embodiments are disclosed of antenna assemblies. In an exemplary embodiment, an antenna assembly generally includes a feed net-
(Continued)

work and a ground plane. Radiating dipoles or dipole radiating elements are along or on opposite sides of the feed network and the ground plane. The radiating dipoles or dipole radiating elements may be operable simultaneously and may co-locate radio frequency currents for a first frequency band and a second frequency band.

22 Claims, 27 Drawing Sheets

Related U.S. Application Data

(60) Provisional application No. 62/037,486, filed on Aug. 14, 2014, provisional application No. 61/970,651, filed on Mar. 26, 2014.

(51) Int. Cl.

| | |
|---|---|
| ***H01Q 1/24*** | (2006.01) |
| ***H01Q 5/30*** | (2015.01) |
| ***H01Q 9/28*** | (2006.01) |
| ***H01Q 21/06*** | (2006.01) |
| ***H01Q 1/42*** | (2006.01) |
| ***H01Q 1/48*** | (2006.01) |
| ***H01Q 1/52*** | (2006.01) |
| ***H01Q 21/00*** | (2006.01) |

(52) U.S. Cl.
CPC ..... *H01Q 1/523* (2013.01); *H01Q 5/30* (2015.01); *H01Q 9/285* (2013.01); *H01Q 21/00* (2013.01); *H01Q 21/062* (2013.01)

(58) Field of Classification Search
USPC ..... 343/700 MS, 795
See application file for complete search history.

(56) References Cited

U.S. PATENT DOCUMENTS

| | | | | |
|---|---|---|---|---|
| 6,008,763 | A | 12/1999 | Nystrom et al. | |
| 6,166,701 | A * | 12/2000 | Park | H01Q 21/0037 333/21 A |
| 6,239,764 | B1 * | 5/2001 | Timofeev | H01Q 1/523 343/700 MS |
| 6,359,596 | B1 * | 3/2002 | Claiborne | H01Q 1/38 343/795 |
| 6,480,157 | B1 * | 11/2002 | Palmer | H01Q 1/08 343/700 MS |
| 7,027,005 | B1 * | 4/2006 | Chien | H01Q 1/246 343/795 |
| 7,109,943 | B2 * | 9/2006 | McCarville | H01Q 13/08 343/700 MS |
| 7,113,142 | B2 * | 9/2006 | McCarville | H01Q 1/286 343/700 MS |
| 7,180,461 | B2 | 2/2007 | Petropoulos et al. | |
| 7,358,912 | B1 * | 4/2008 | Kish | H01Q 3/242 343/725 |
| 7,530,180 | B2 * | 5/2009 | Chiang | H01Q 1/242 343/702 |
| 7,688,271 | B2 * | 3/2010 | Cao | H01Q 9/28 343/797 |
| 7,978,144 | B2 * | 7/2011 | Tanabe | H01Q 1/246 343/810 |
| 8,018,381 | B2 * | 9/2011 | Mori | H01Q 1/246 342/374 |
| 8,059,049 | B2 * | 11/2011 | Quan | H01Q 1/085 343/700 MS |
| 9,331,390 | B2 | 5/2016 | Petropoulos | |
| 9,485,037 | B1 * | 11/2016 | Weller | H04B 17/02 |
| 9,735,474 | B2 * | 8/2017 | Shmuel | H01Q 21/00 |
| 2007/0052589 | A1 | 3/2007 | Liu | |
| 2007/0117514 | A1 * | 5/2007 | Gainey | H01Q 1/38 455/63.4 |
| 2008/0139136 | A1 * | 6/2008 | Shtrom | H01Q 3/242 455/101 |
| 2009/0009399 | A1 * | 1/2009 | Gaucher | H01Q 21/0006 343/700 MS |
| 2009/0237318 | A1 * | 9/2009 | Brown | H01Q 13/04 343/773 |
| 2009/0303691 | A1 * | 12/2009 | Choi | H05K 1/147 361/768 |
| 2010/0033396 | A1 * | 2/2010 | Tanabe | H01Q 1/246 343/834 |
| 2012/0025848 | A1 * | 2/2012 | Hasch | B23D 59/005 324/640 |
| 2012/0044118 | A1 | 2/2012 | Lee et al. | |
| 2012/0119954 | A1 | 5/2012 | Chen | |
| 2012/0146872 | A1 * | 6/2012 | Chainon | H01Q 1/523 343/818 |
| 2012/0169561 | A1 * | 7/2012 | Bin Basri | H01Q 21/12 343/814 |
| 2013/0169505 | A1 * | 7/2013 | Shmuel | H01Q 1/088 343/848 |
| 2014/0009894 | A1 * | 1/2014 | Yu | H05K 5/0021 361/735 |
| 2015/0280324 | A1 * | 10/2015 | Petropoulos | H01Q 9/285 343/795 |
| 2015/0372377 | A1 * | 12/2015 | Lewis | H01Q 1/523 343/816 |

FOREIGN PATENT DOCUMENTS

| | | | | |
|---|---|---|---|---|
| JP | 2013175895 | A | 9/2013 | |
| WO | WO 2005041357 | A1 * | 5/2005 | H01Q 1/12 |

OTHER PUBLICATIONS

Vertically Polarized Omni Antennas OC24527; Dual-Band Vertically Polarized Omni Antenna; Copyright 2011; 1 page.
OC24527 Specifications; date unknown; 1 page.
Chinese Office Action dated Mar. 23, 2017 for Chinese application No. 201480077462.1 filed Aug. 25, 2014 which claims priority to the same parent application as the instant application, 7 pages.

* cited by examiner

2450 MHZ

ANTENNA ASSEMBLIES

CROSS-REFERENCE TO RELATED APPLICATIONS

This patent application is a U.S. national stage filing under 35 U.S.C. § 371 of International Application No. PCT/US2014/052550 filed Aug. 25, 2014 (published as WO 2015/147906 on Oct. 1, 2015), which claims the benefit and priority to:

- U.S. provisional patent application No. 62/037,486 filed Aug. 14, 2014;
- U.S. Provisional Application No. 61/970,651 filed Mar. 26, 2014; and
- US. Non-provisional application Ser. No. 14/227,710 filed Mar. 27, 2014 (now issued as U.S. Pat. No. 9,331,390 issued May. 3, 2016), which, in turn, claimed the benefit and priority to U.S. Provisional Application No. 61/970,651 filed Mar. 26, 2014. The entire disclosures of the applications identified in this paragraph are incorporated herein by reference.

FIELD

The present disclosure generally relates to antenna assemblies.

BACKGROUND

This section provides background information related to the present disclosure which is not necessarily prior art.

Wireless local area networks (WLAN) may operate in multiple frequency ranges, such as, for example, a range between about 2.4 GHz and about 2.5 GHz, and a range between about 5.15 GHz and about 5.9 GHz. These WLAN networks may be used indoors or outdoors. Omnidirectional antennas may be configured to radiate approximately equally in all directions, and may be configured to radiate at multiple operating frequencies.

SUMMARY

This section provides a general summary of the disclosure, and is not a comprehensive disclosure of its full scope or all of its features.

According to various aspects, exemplary embodiments are disclosed of antenna assemblies. In an exemplary embodiment, an antenna assembly generally includes a feed network and a ground plane. Radiating dipoles or dipole radiating elements are along or on opposite sides of the feed network and the ground plane. The radiating dipoles or dipole radiating elements may be operable simultaneously and may co-locate radio frequency currents for a first frequency band and a second frequency band.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
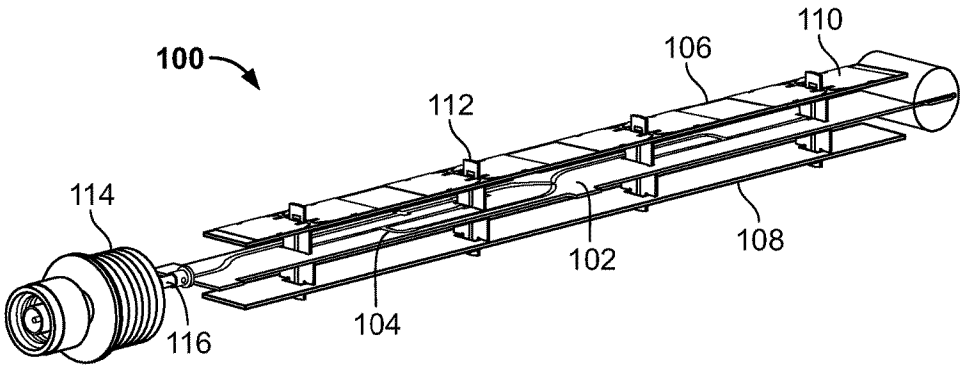
FIG. 2 is a perspective view of the antenna components shown in FIG. 1 after being assembled and without showing the radome.
Figure 11:
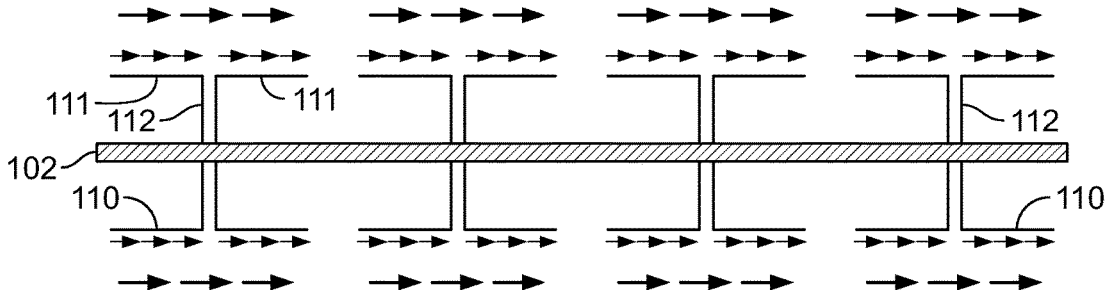
Figure 12:
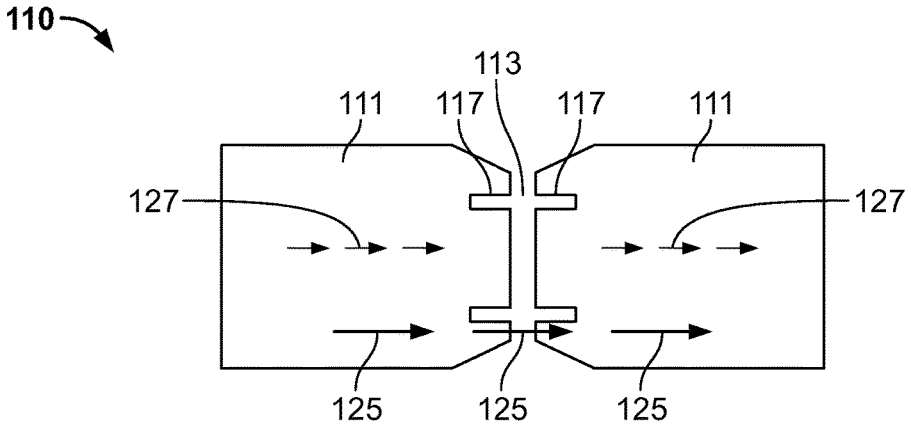
Figure 13:
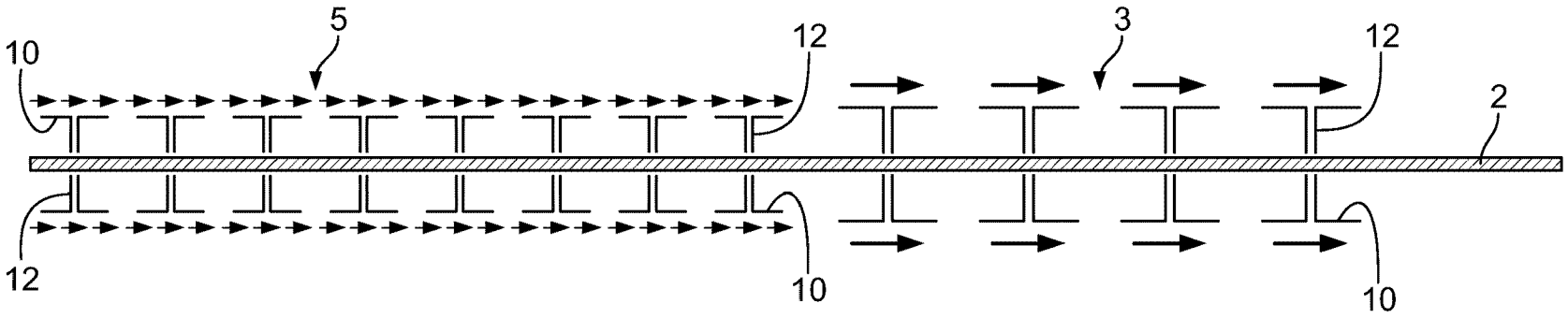
FIG. 13 (Prior Art)
Figure 14:
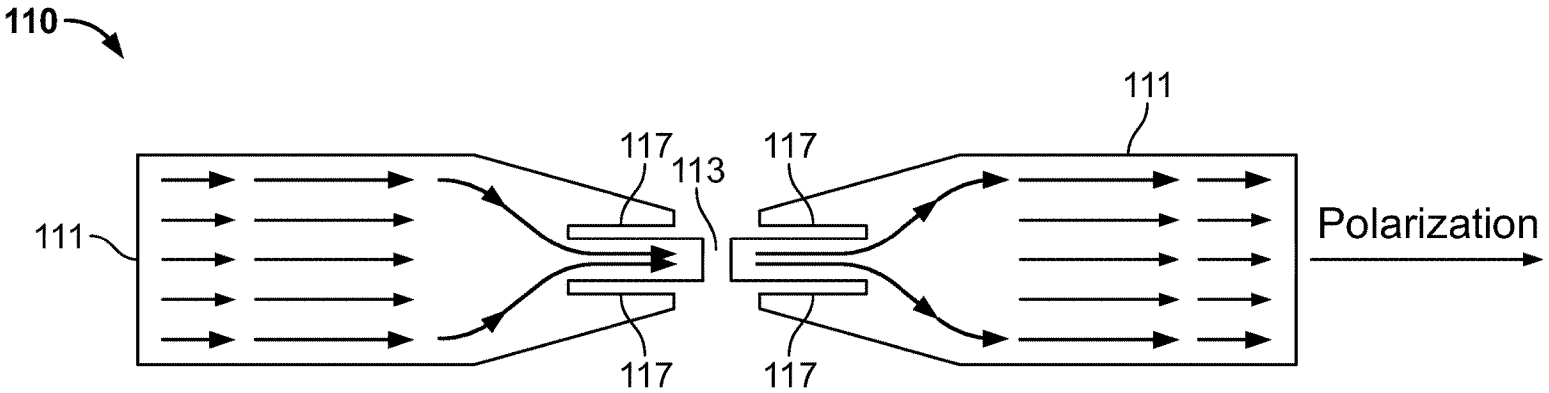
Figure 15:
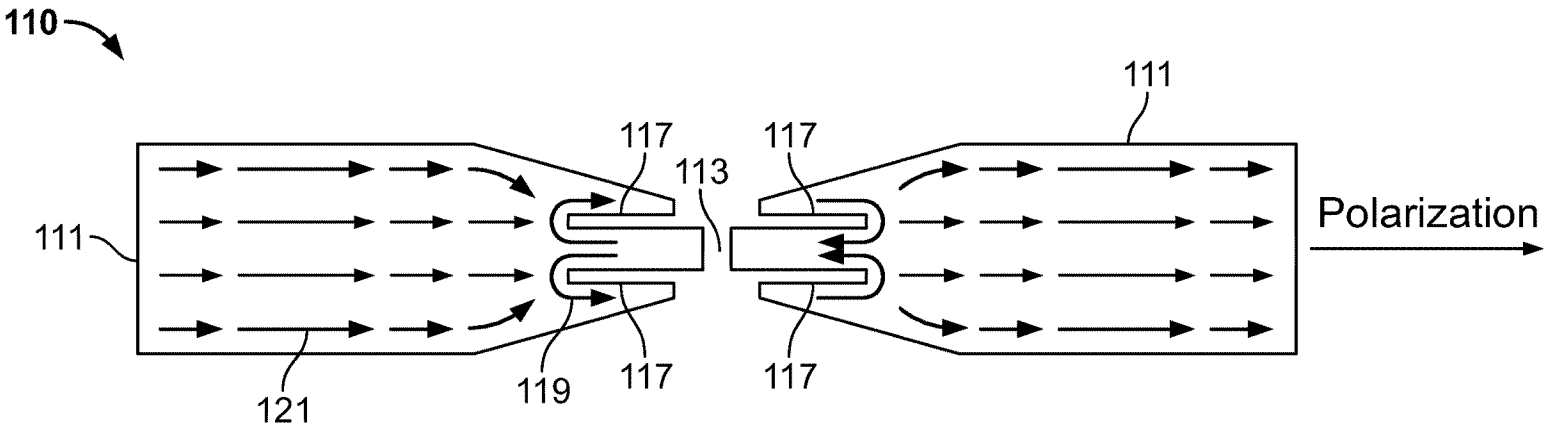
Figure 16:
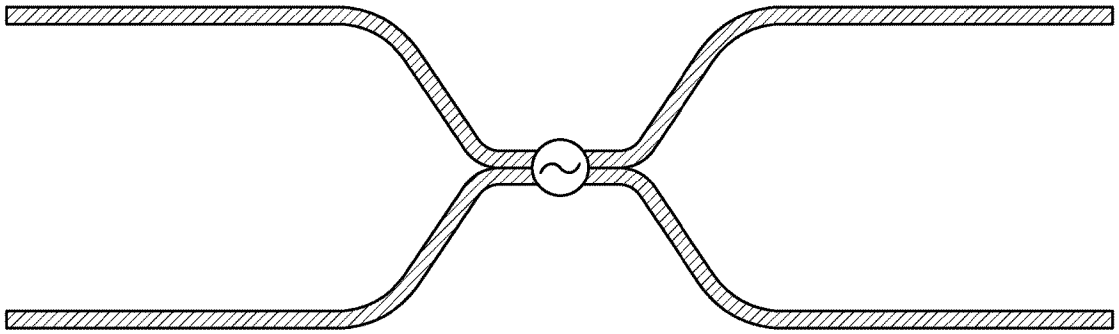
Figure 17:
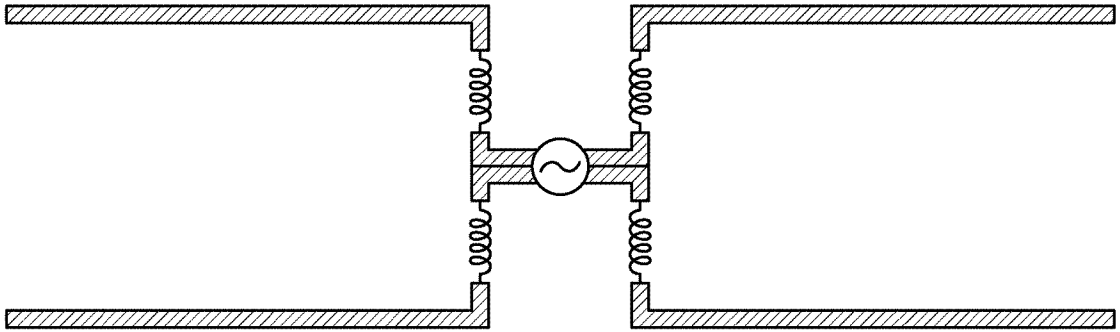
Figure 18:
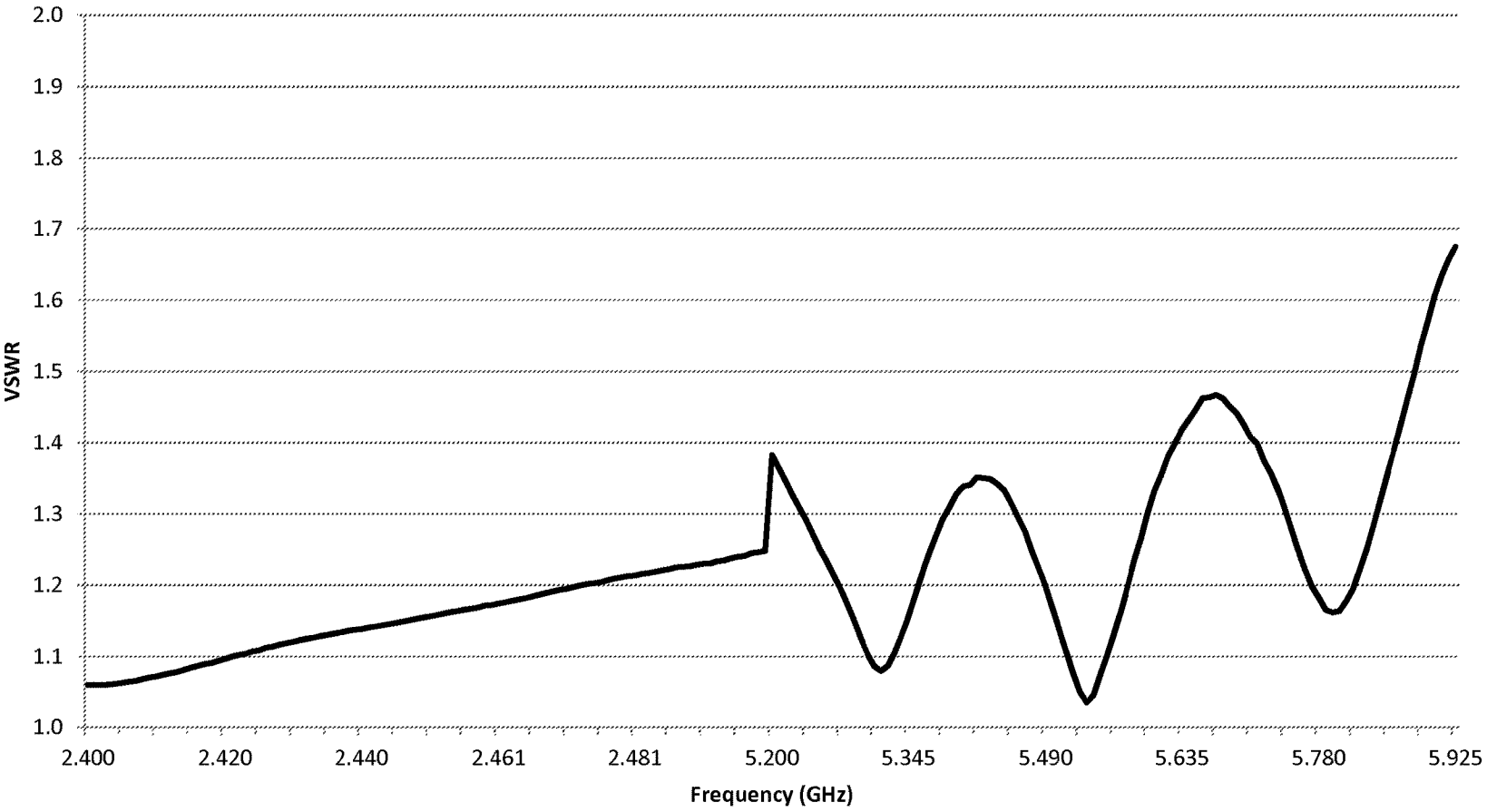
Figure 19:
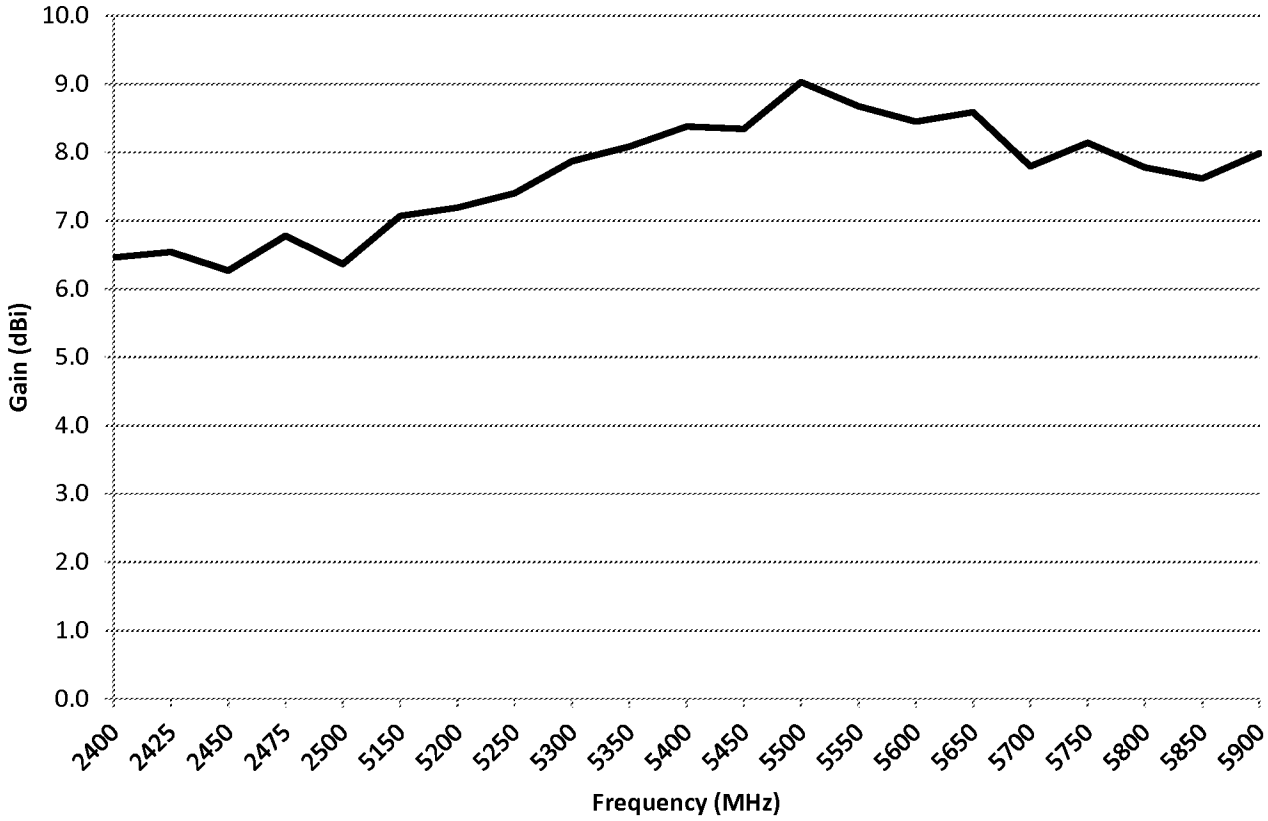
Figure 20:
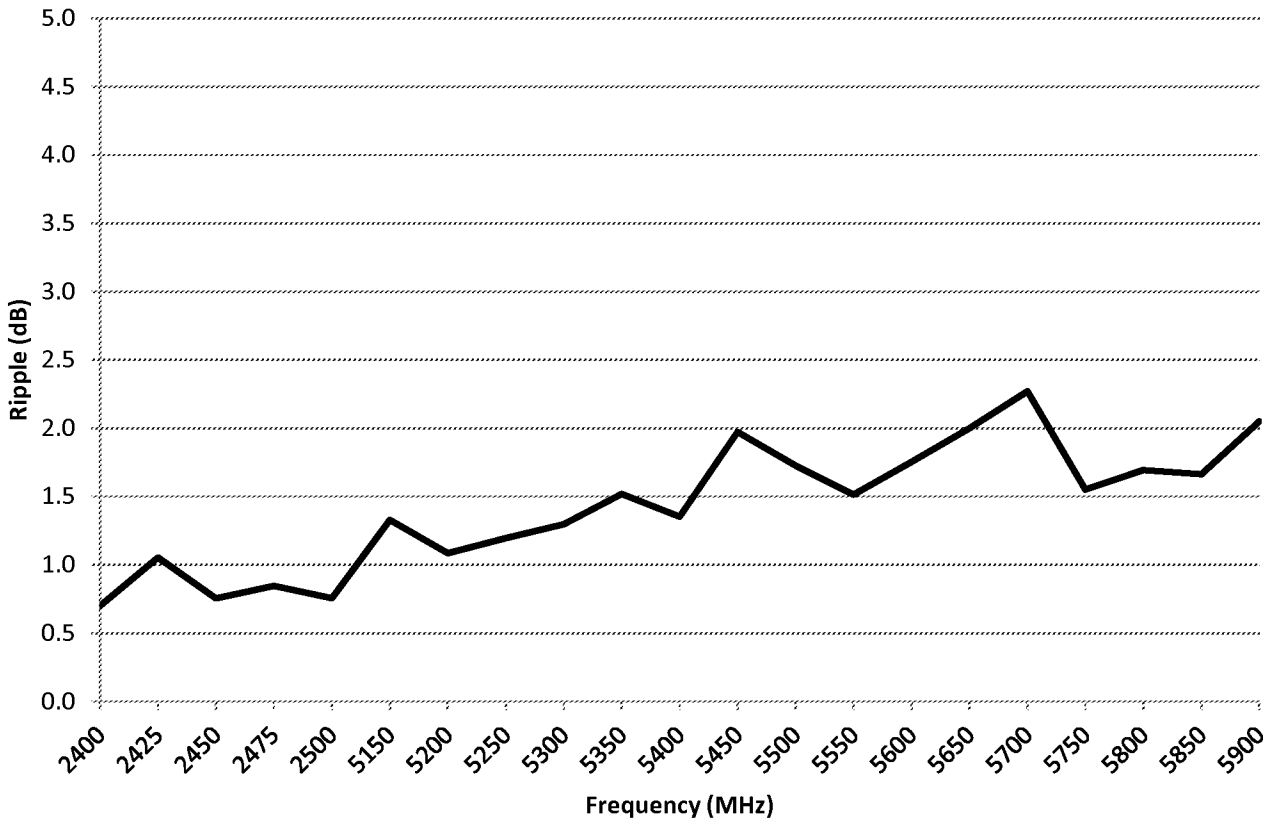
Figure 21:
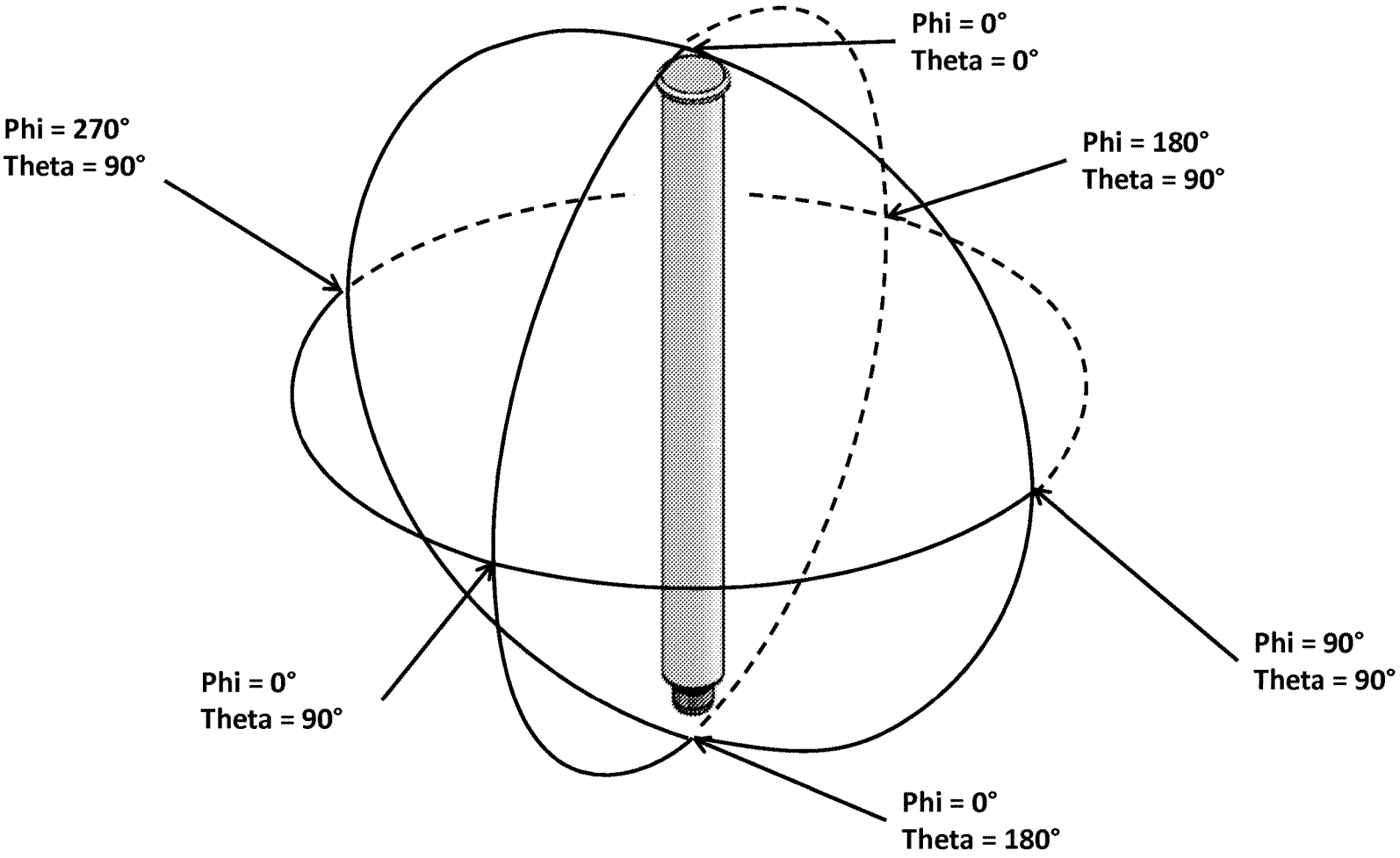
Figure 22:
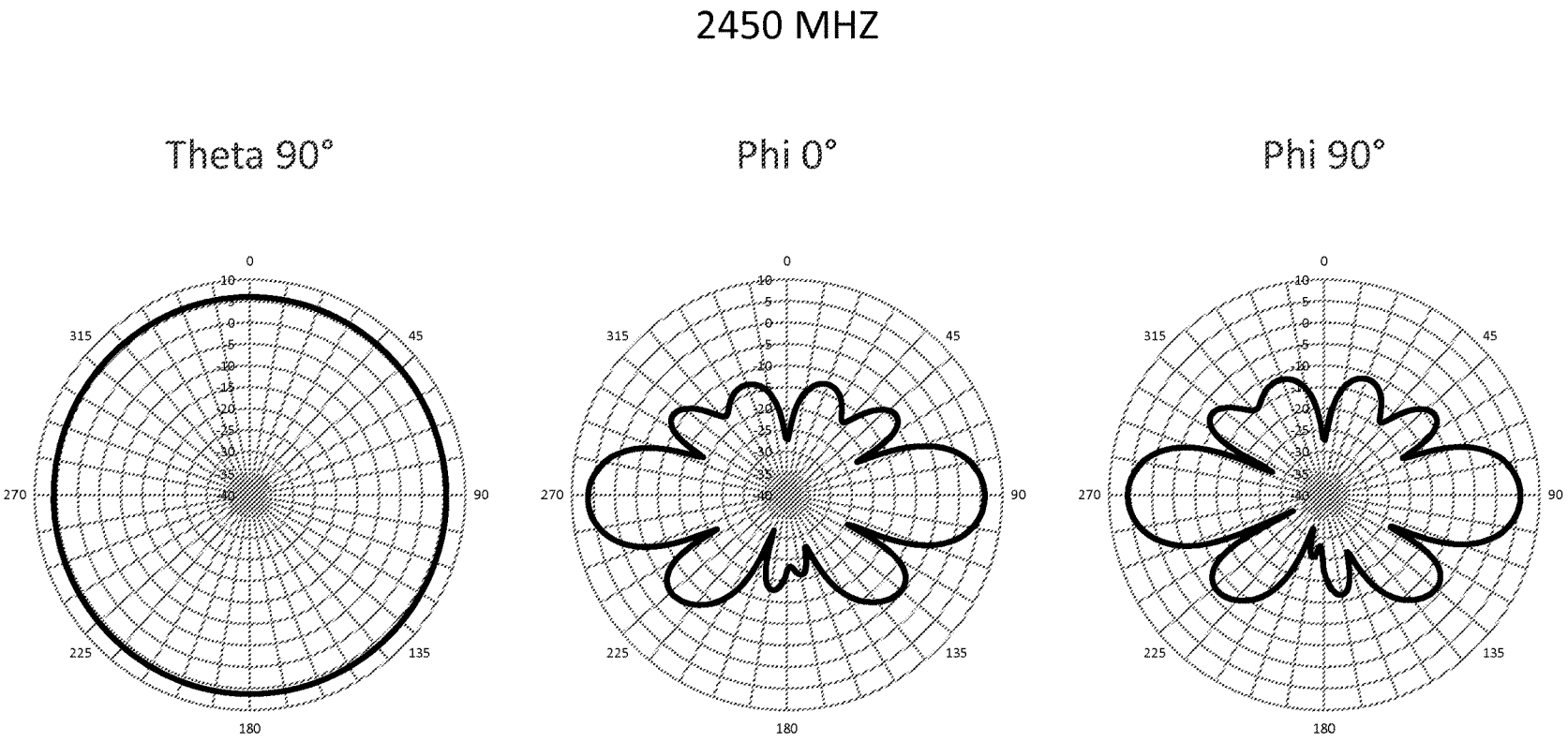
Figure 23:
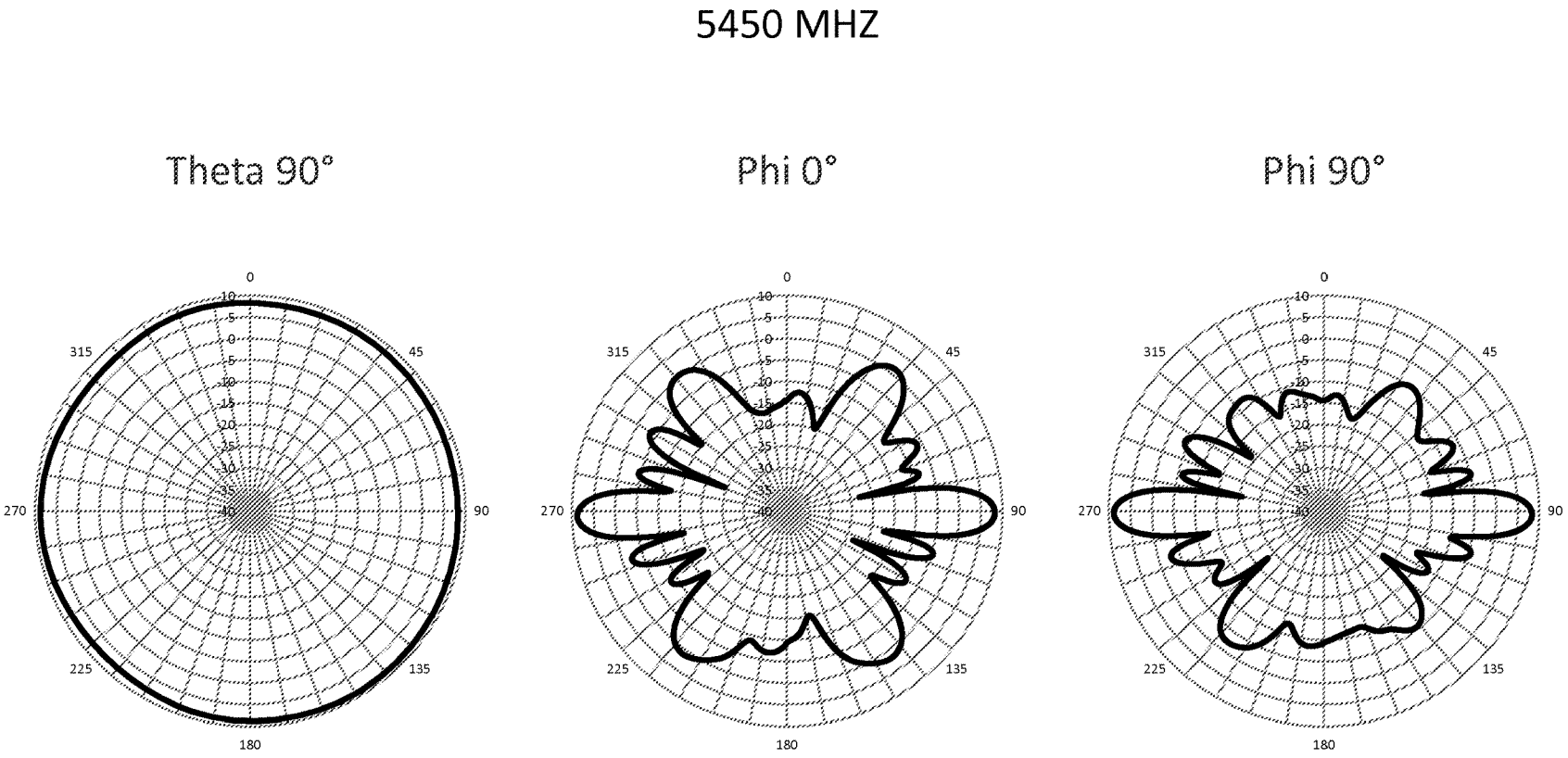
Figure 24:
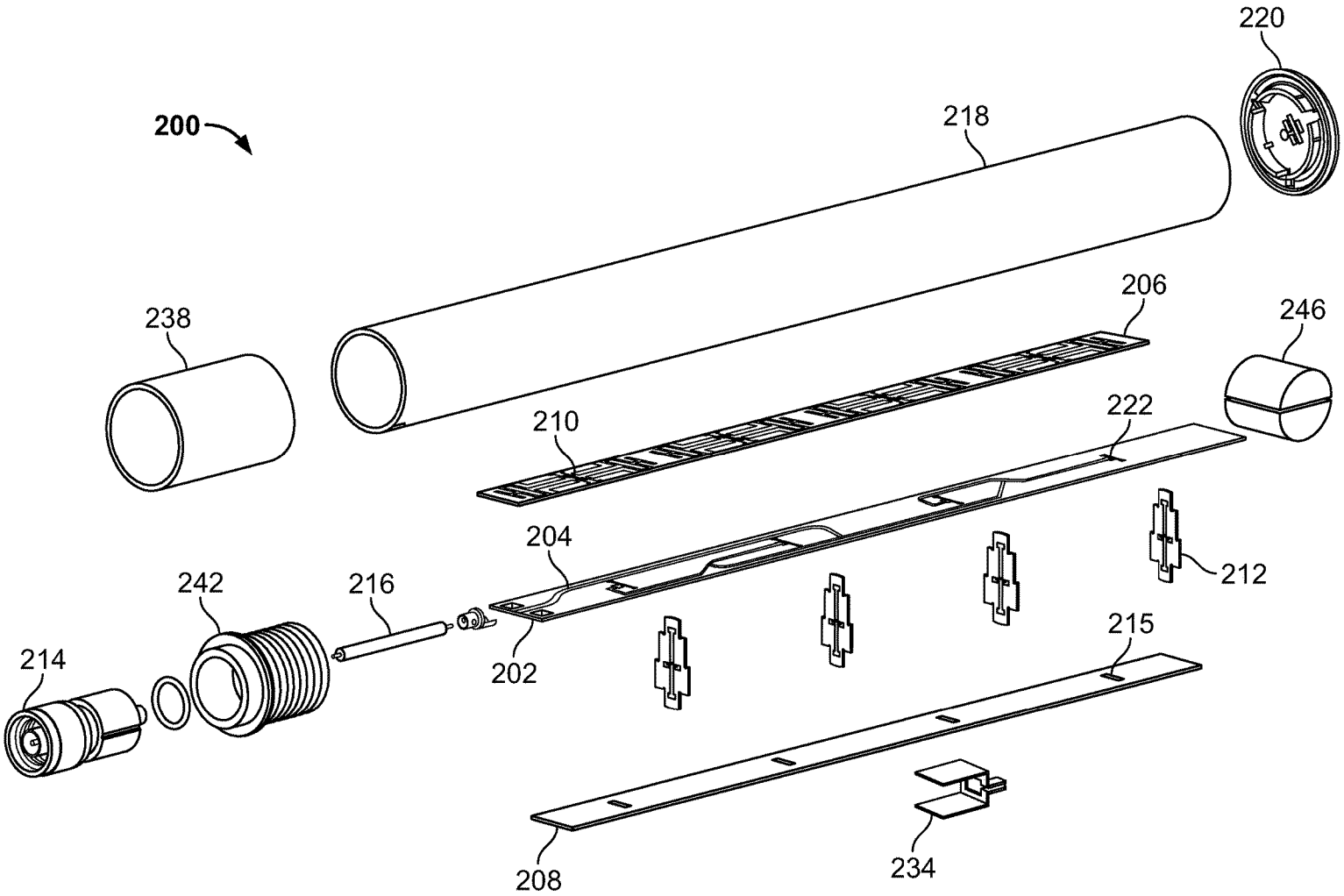
Figure 25:
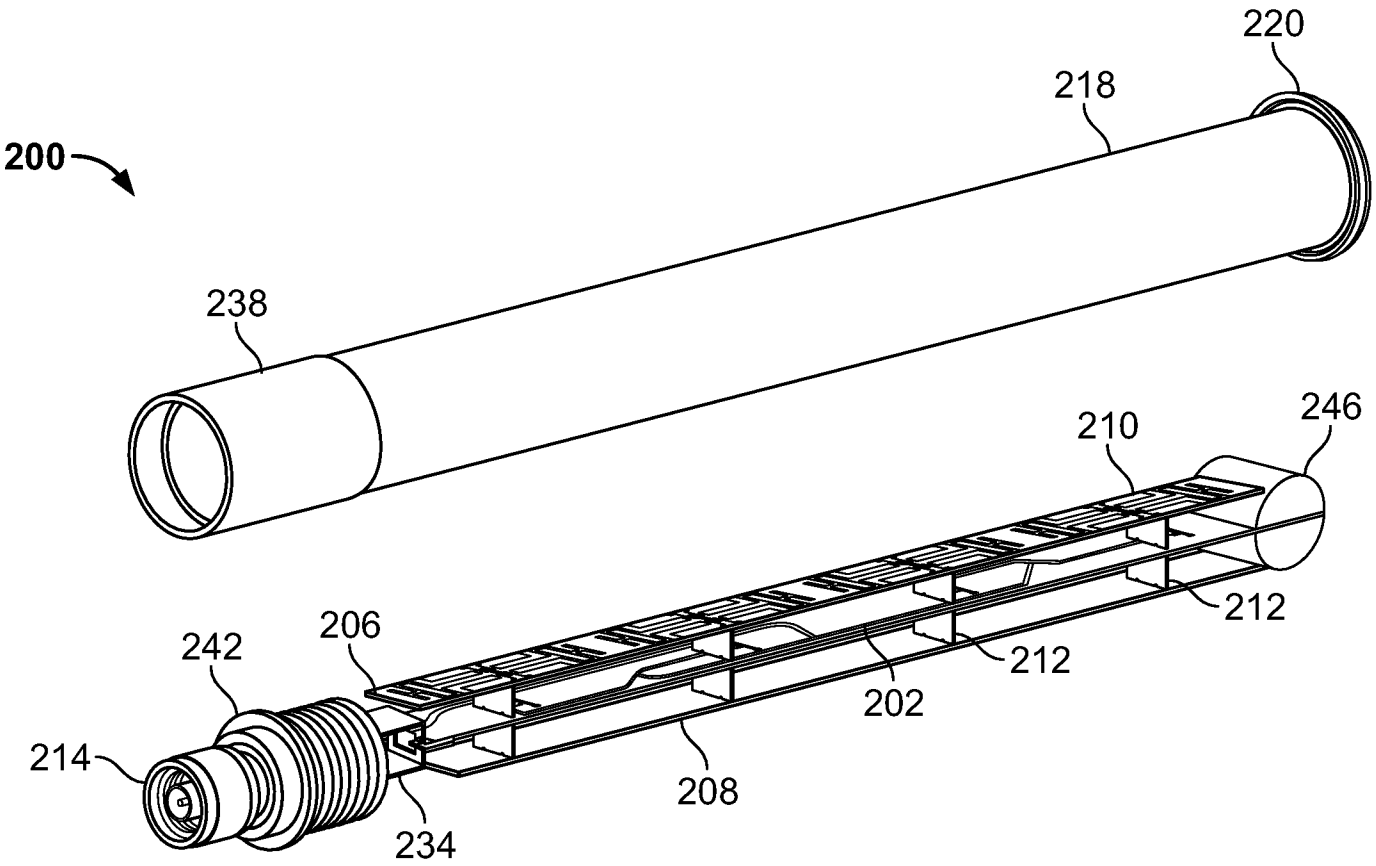
Figure 26:
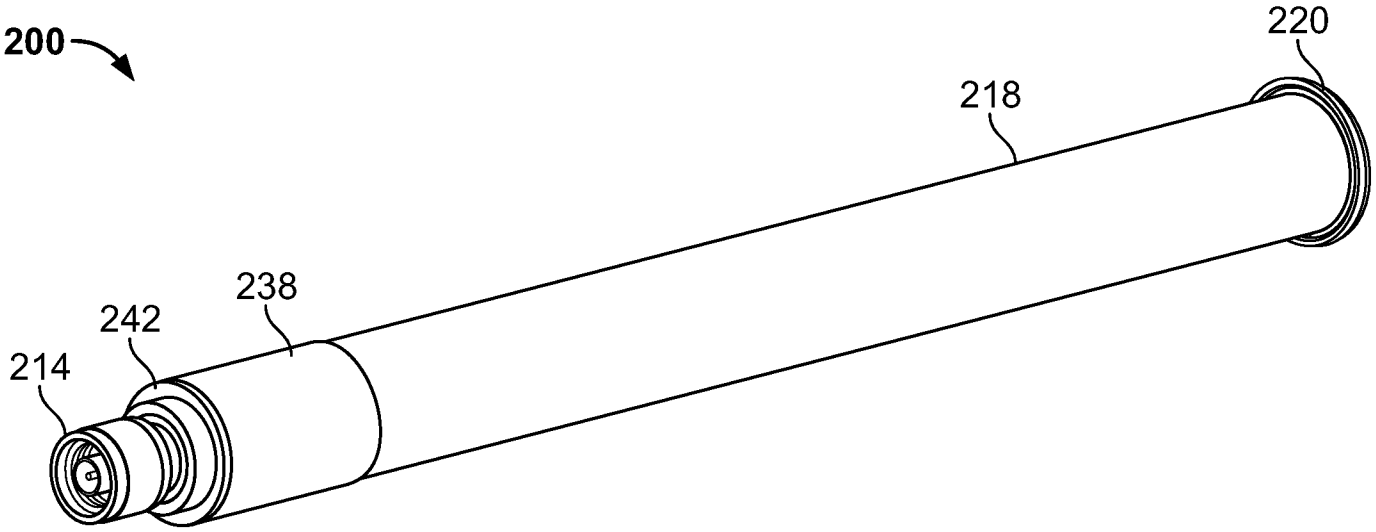
Figure 27:
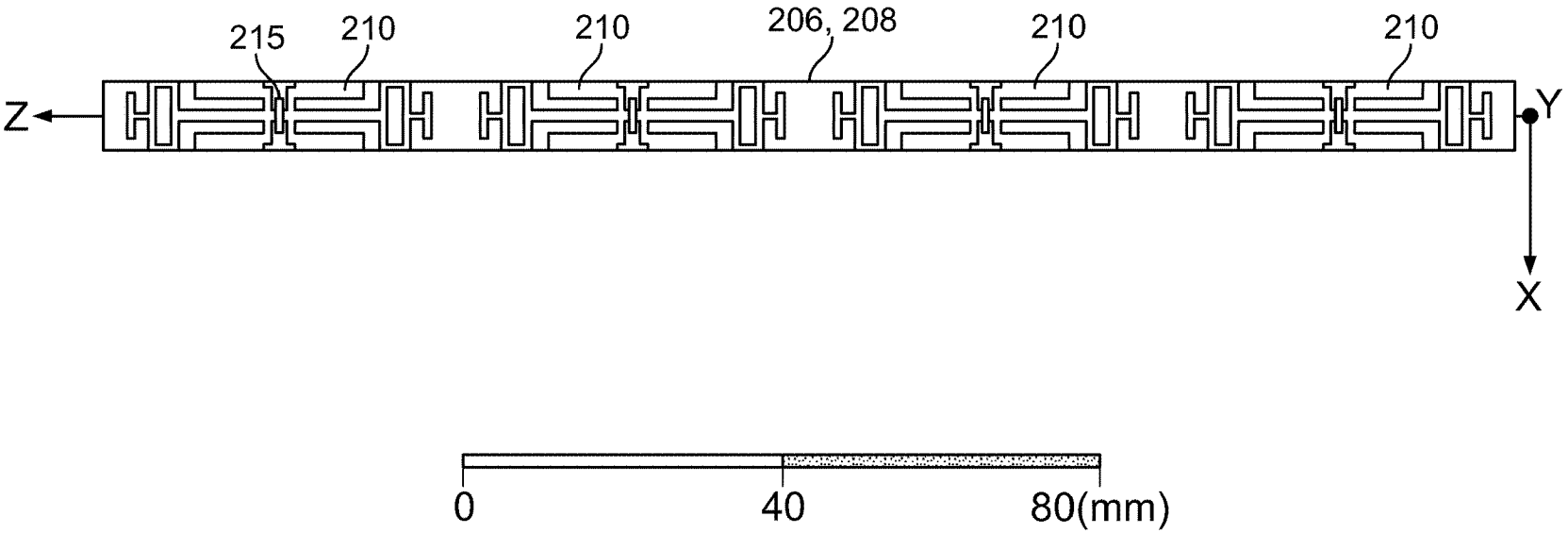
Figure 28:
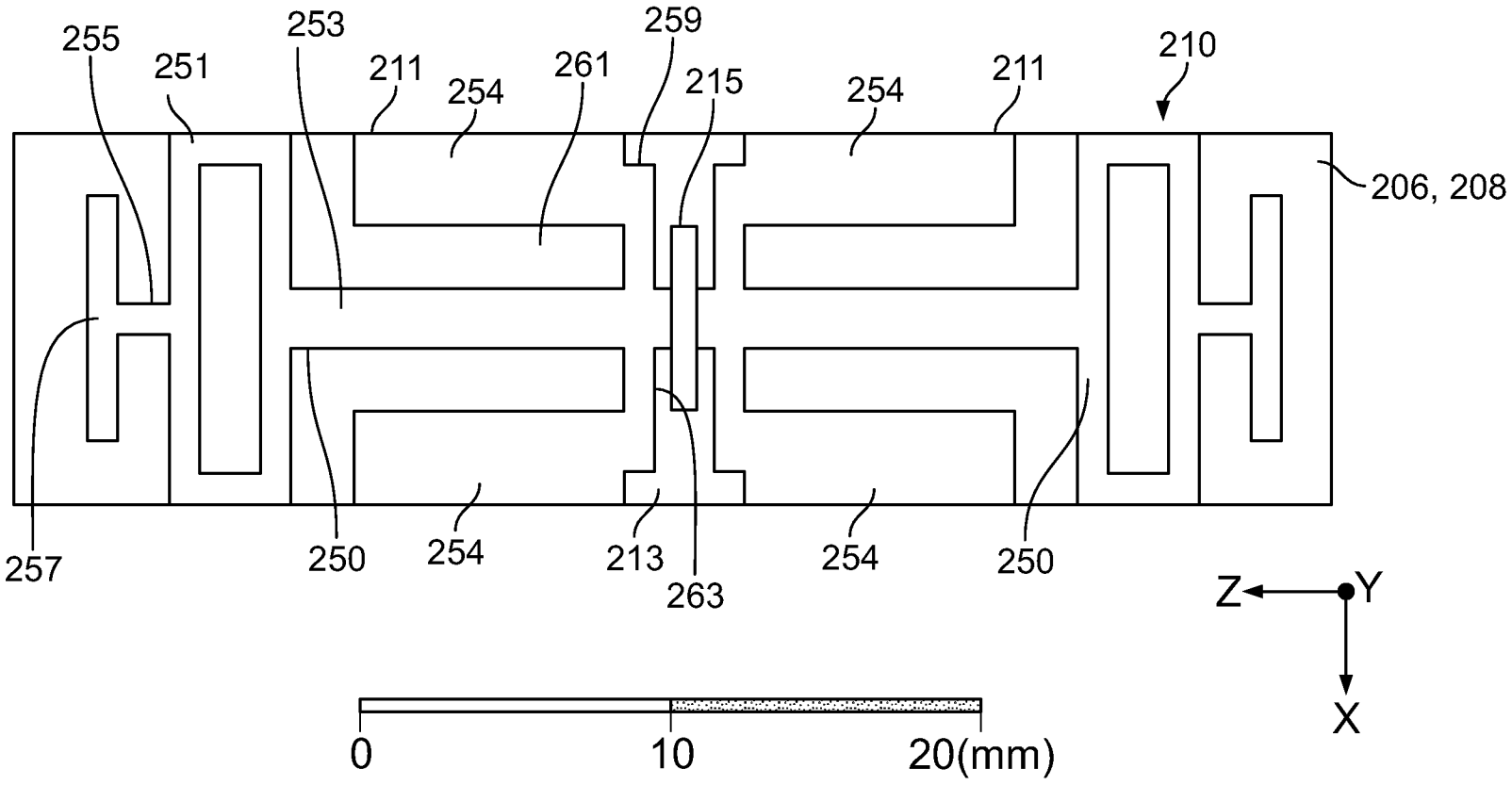
Figure 29:
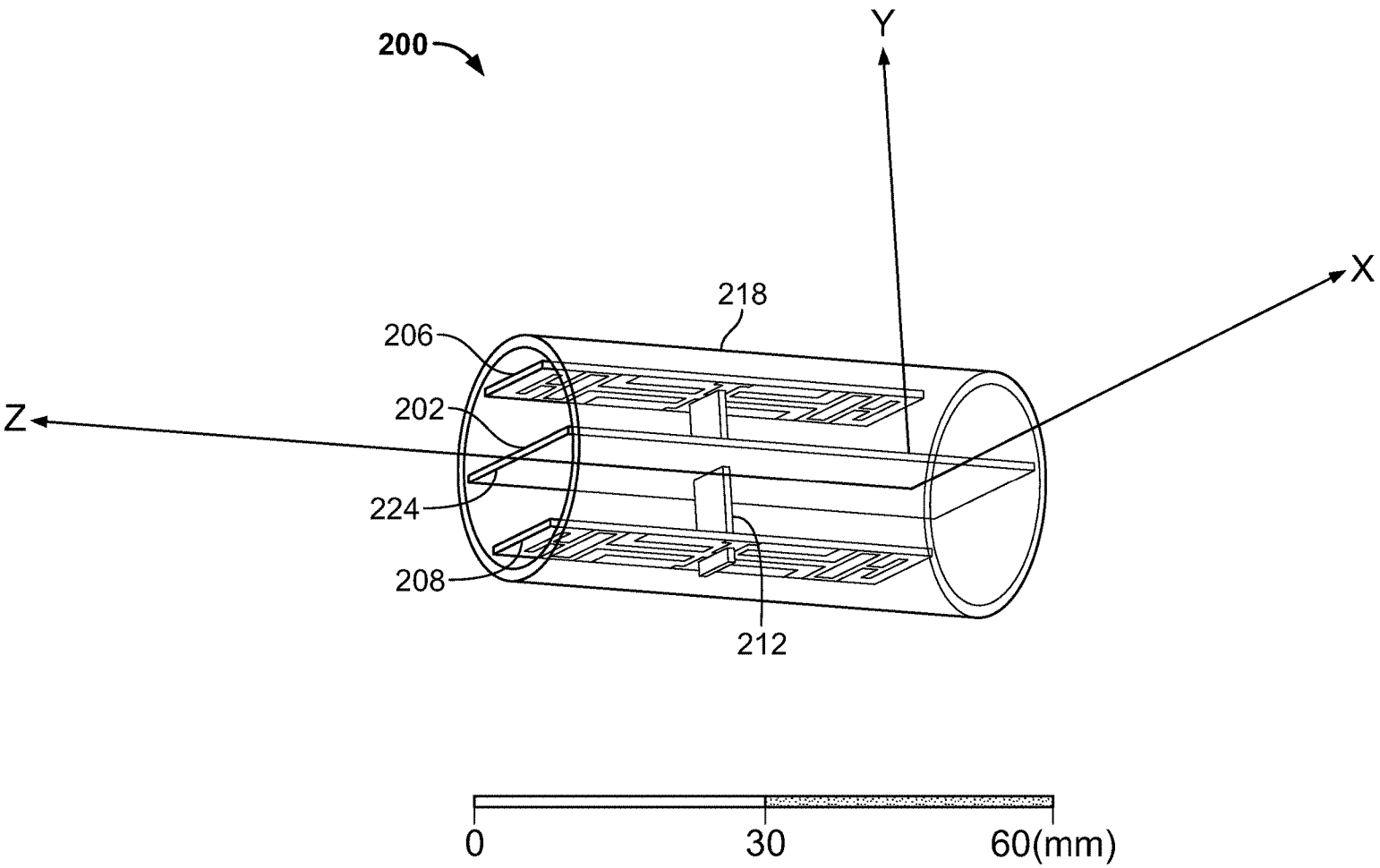
Figure 30:
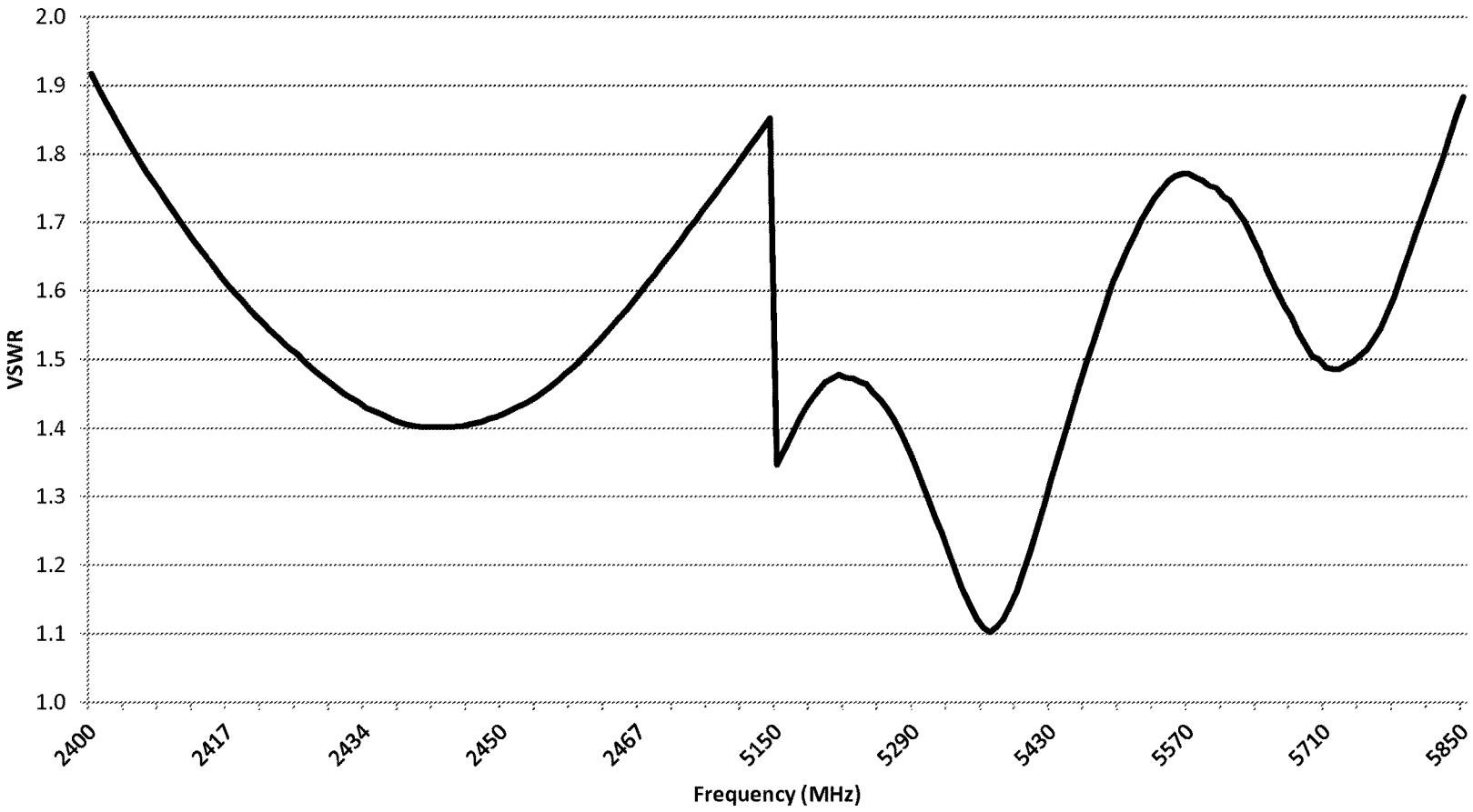
Figure 31:
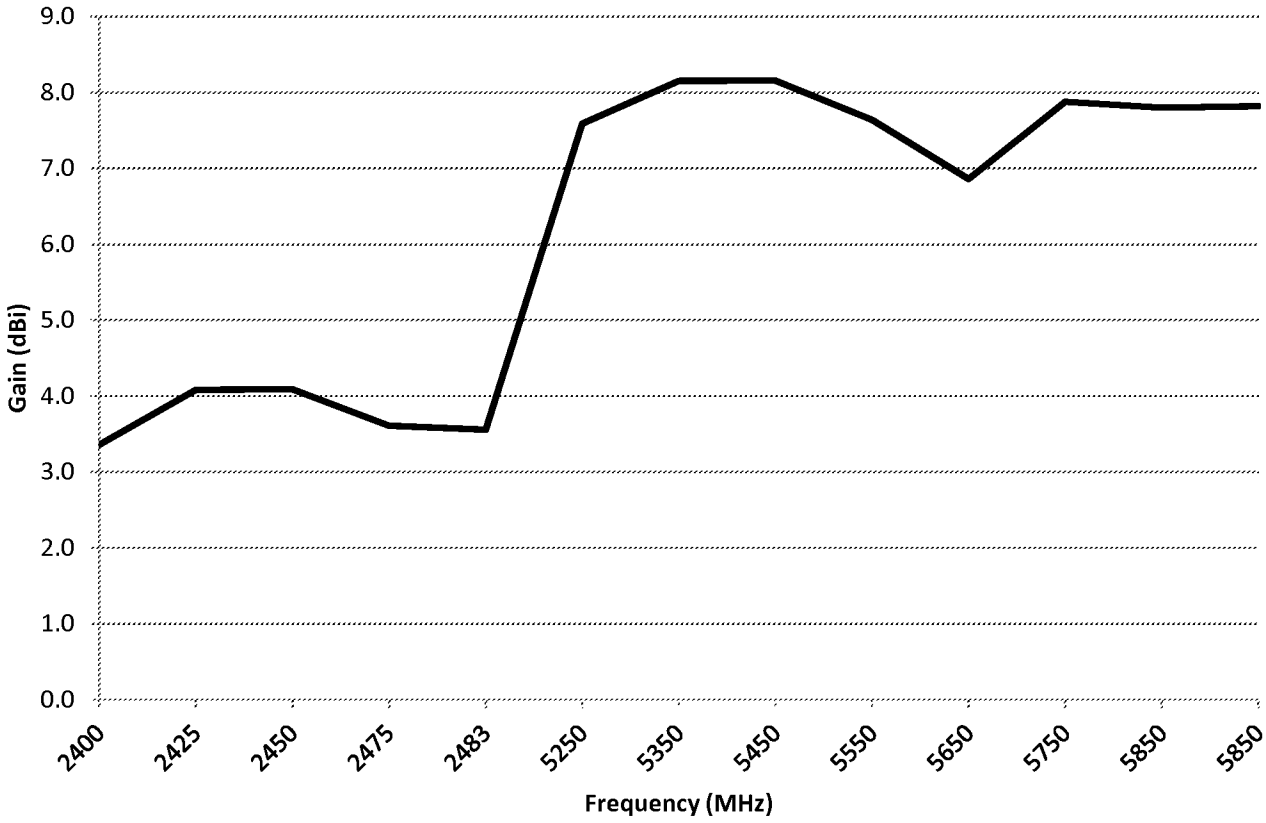
Figure 32:
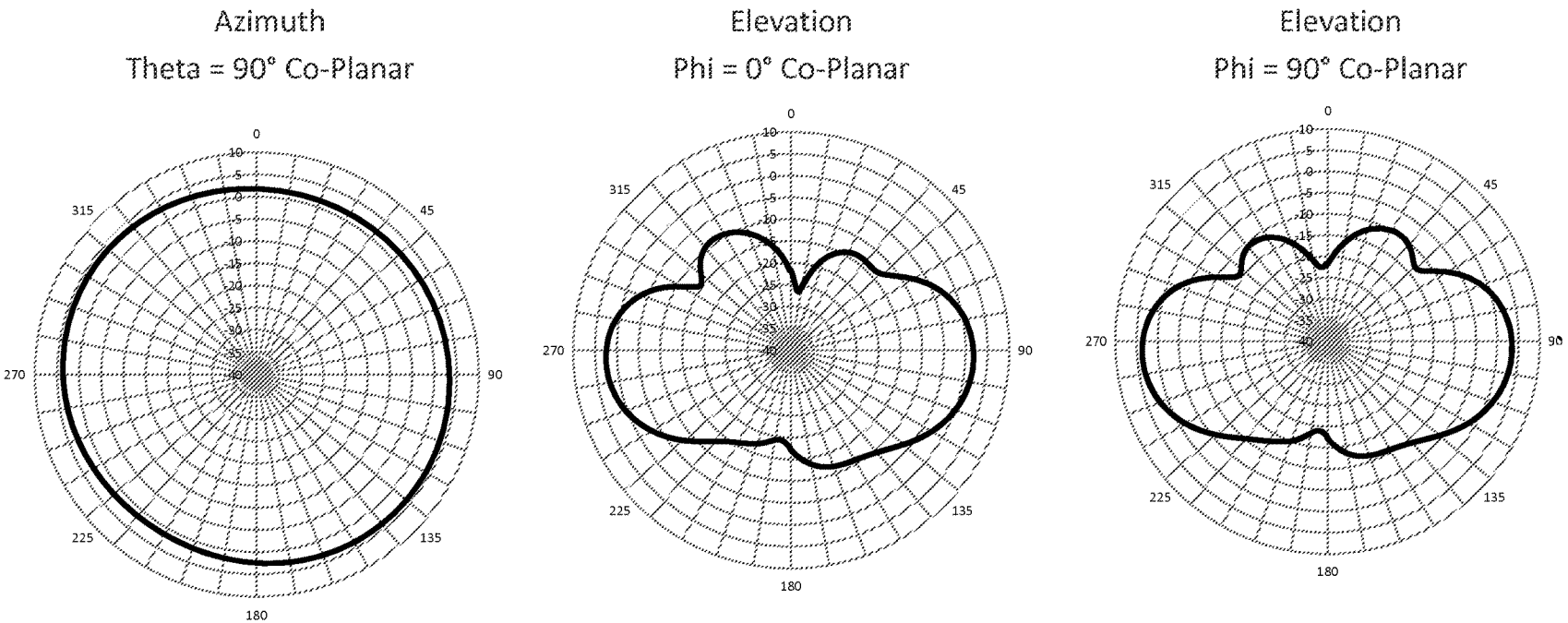
Figure 33:
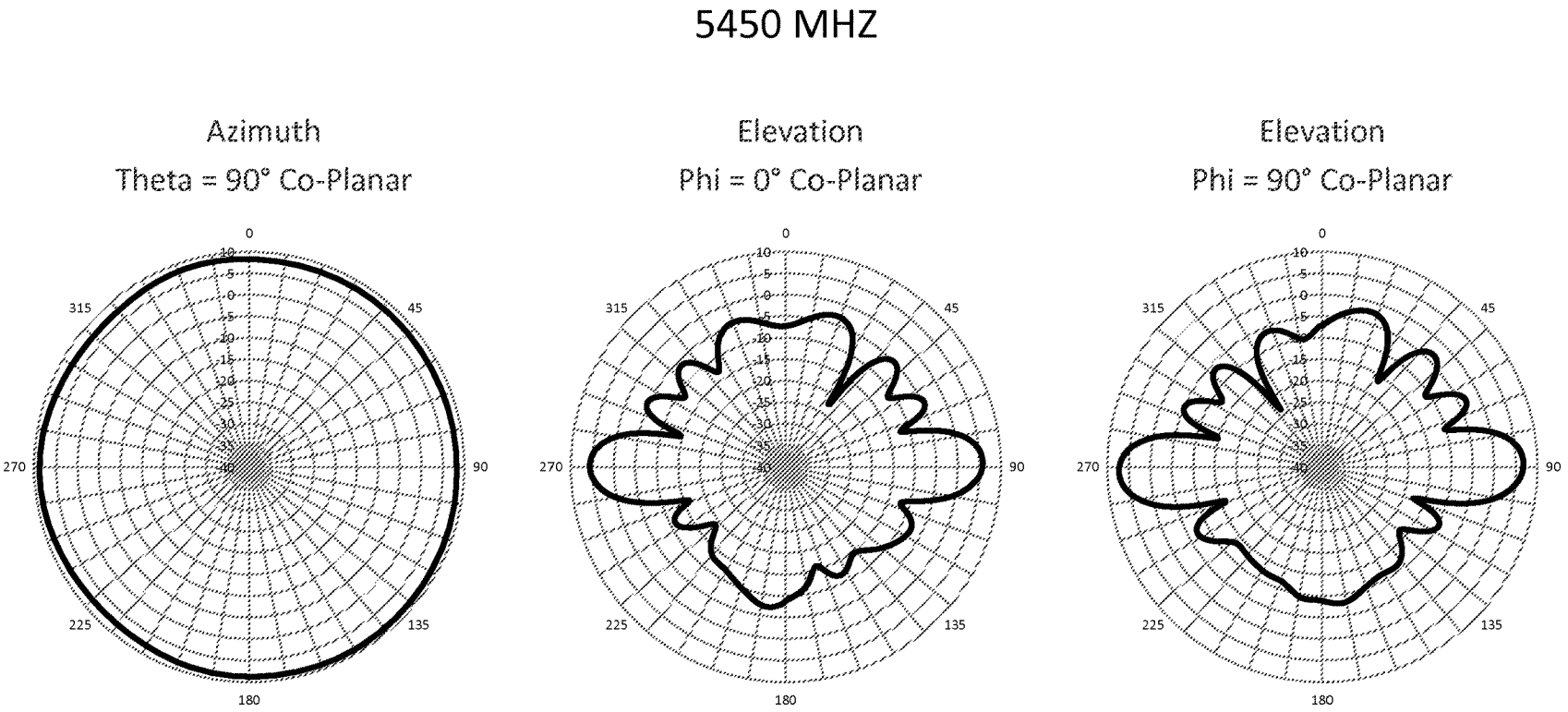

FIG. 11 is a side view of a portion of the antenna assembly shown in FIG. 2, and illustrating how a four dipole-like 2.4 GHz array may be co-located with an eight dipole-like 5 GHz array in this exemplary embodiment, where the arrows indicate radiating currents for the 2.4 GHz band and 5 GHz band that are co-located on the radiating elements;

FIG. 12 is a top view of a dipole or radiating element shown in FIG. 11, where the arrows indicate radiating currents for the 2.4 GHz band and 5 GHz band that are co-located on the radiating element, and also illustrating how the radiating element is operable as a typical single dipole element for the 2.4 GHz band and operable as two separate dipole-like elements separated by a distance for the 5 GHz band;

FIG. 13 is a side view of a conventional antenna that includes twelve different radiating elements on each side, where an array of four dipole radiating elements is operable for the low band (2.4 GHz band) and another array of eight dipole radiating elements is operable for the high band (5 GHz band), where the arrows indicate radiating currents at 2.4 GHz and 5 GHz separately located on the respective four and eight dipole arrays;

FIG. 14 shows an example current flow in a dipole of the antenna assembly shown in FIG. 2 when the dipole is operated at a frequency of about 2.5 GHz;

FIG. 15 shows an example current flow in a dipole of the antenna assembly shown in FIG. 2 when the dipole is operated at a frequency of about 5.5 GHz;

FIG. 16 is an example circuit model for the dipole shown in FIG. 14 when the dipole is operated at a frequency of about 2.5 GHz;

FIG. 17 is an example circuit model for the dipole shown in FIG. 15 when the dipole is operated at a frequency of about 5.5 GHz;

FIG. 18 is an exemplary line graph of the voltage standing wave ratio (VSWR) versus frequency in gigahertz (GHz) measured for a physical prototype of the antenna assembly including the radome shown in FIGS. 1 through 4;

FIG. 19 is an exemplary line graph of the peak gain in decibels relative to isotropic (dBi) versus frequency in megahertz (MHz) measured for the physical prototype of the antenna assembly including the radome shown in FIGS. 1 through 4;

FIG. 20 is an exemplary line graph of the ripple in decibels (dB) versus frequency (MHz) measured for the physical prototype of the antenna assembly including the radome shown in FIGS. 1 through 4;

FIG. 21 shows the pattern orientation and planes relative to an antenna during radiation pattern testing;

FIG. 22 illustrates radiation patterns (Theta 90°, Phi 0°, and Phi 90° plane) measured for the physical prototype of the antenna assembly including the radome shown in FIGS. 1 through 4 at a frequency of about 2450 MHz;

FIG. 23 illustrates radiation patterns (Theta 90°, Phi 0°, and Phi 90° plane) measured for the physical prototype of the antenna assembly including the radome shown in FIGS. 1 through 4 at a frequency of about 5500 MHz;

FIG. 24 is an exploded perspective view of an antenna assembly according to another exemplary embodiment;

FIG. 25 is a perspective view of the antenna components shown in FIG. 24 after being assembled;

FIG. 26 is a perspective view of the antenna assembly shown in FIG. 24 after being fully assembled;

FIG. 27 is a plan view of one of the two radiating boards shown in FIGS. 24 and 25, and illustrating an array of four radiating dual band dipoles spaced apart along the board according to this exemplary embodiment, where the 0 to 80 mm scale is shown for purpose of illustration only;

FIG. 28 is a plan view of a single radiating dipole of the dipole array shown in FIG. 27, and illustrating the symmetrical shapes of the high band dipole branches and the symmetrical shapes of the low band dipole branches according to this exemplary embodiment, where the 0 to 20 mm scale is shown for purpose of illustration only;

FIG. 29 is a perspective view of a portion of the antenna assembly shown in FIG. 25, and illustrating an interconnect board, a network board having a ground along its lower surface, and two radiating boards having dipoles where the radiating boards are along opposite upper and lower sides of the network board according to this exemplary embodiment, where the 0 to 60 mm scale is shown for purpose of illustration only;

FIG. 30 is an exemplary line graph of the voltage standing wave ratio (VSWR) versus frequency in gigahertz (GHz) measured for a physical prototype of the antenna assembly including the radome shown in FIGS. 24 through 26;

FIG. 31 is an exemplary line graph of peak gain in decibels relative to isotropic (dBi) versus frequency in megahertz (MHz) measured for the physical prototype of the antenna assembly including the radome shown in FIGS. 24 through 26;

FIG. 32 illustrates radiation patterns (Azimuth Theta=90° Co-Planar, Elevation Phi=0° Co-Planar, and Elevation Phi=90° Co-Planar) measured for a physical prototype of the antenna assembly including the radome shown in FIGS. 24 through 26 at a frequency of about 2450 MHz; and FIG. 33 illustrates radiation patterns (Azimuth Theta=90° Co-Planar, Elevation Phi=0° Co-Planar, and Elevation Phi=90° Co-Planar) measured for a physical prototype of the antenna assembly including the radome shown in FIGS. 24 through 26 at a frequency of about 5450 MHz.

DETAILED DESCRIPTION

Example embodiments will now be described more fully with reference to the accompanying drawings.

The inventor has developed and discloses herein exemplary embodiments of antennas assemblies that may be multi-band, compact, and omnidirectional. The antenna assemblies may be used for indoor/outdoor wireless local area network (WLAN) applications. The antenna assemblies may operate in multiple bands including a first or low band (e.g., 2.4 GHz band, etc.) and a second or high band (e.g., 5 GHz band, etc.). Accordingly, the antenna assemblies may thus operate within multiple frequency ranges or band (e.g., multiple Wi-Fi bands, etc.) including a first or low frequency range or band (e.g., from about 2.4 GHz to about 2.5 GHz) and a second or high frequency range or band (e.g., from about 5.15 GHz to about 5.9 GHz).

Antenna assemblies disclosed herein may have a good gain while radiating omnidirectionally in the horizon at frequencies from about 2.4 GHz to about 2.5 GHz and from about 5.15 GHz to about 5.9 GHz. For example, an antenna assembly may have a high gain of between about eight decibels and about ten decibels (dB) for Wi-Fi band frequencies. Or, for example, an antenna assembly may have a high gain of greater than about seven decibels relative to isotropic (dBi) while radiating omnidirectionally in the horizon at frequencies from about 2.4 GHz to about 2.5 GHz and from about 5.15 GHz to about 5.9 GHz. As another example, an antenna assembly may have a measured radiating gain averaging 4 dBi at low band (e.g., 2.4 GHz band, etc.) band and about 7.5 dBi at high band (e.g., 5 GHz band, etc.).

Antenna assemblies disclosed herein may have a compact size (e.g., length less than about 15 inches or 381 millimeters, length less than 8 inches or 203.2 millimeters, diameter of about 1.5. inches or 38.1 millimeters, etc.). The antenna assemblies may have a low omnidirectional radiation ripple (e.g., less than two decibels, etc.) in the horizon for all operating frequencies. The antenna assemblies may have a low voltage standing wave ratio (VSWR) of less than 2:1 and/or less than 1.5:1 for some or most frequencies. For example, the VSWR in the connector of an antenna assembly may be less than 2:1 at both the low band and high band simultaneously.

In exemplary embodiments, an antenna assembly includes an array of radiating dipoles (e.g., radiating elements printed on printed circuit boards, etc.) along and spaced apart from opposite sides of a network board. The network board may be a printed circuit board having a first or upper side that includes a feed network (e.g., a microstrip feedline network, transmission line network, electrically-conductive traces, etc.) and a second or lower side that includes a ground plane (e.g., electrically-conductive laminate, etc.).

A first set or plurality of radiating elements (e.g., an array of four dipoles, etc.) is spaced apart along (e.g., equally spaced apart, etc.) a first radiating board, which, in turn, is spaced apart from the first side of the network board. A second set or plurality of radiating elements (e.g., an array of four dipoles, etc.) is spaced apart along (e.g., equally spaced apart, etc.) a second radiating board, which, in turn, is spaced apart from the second side of the network board. The first and second set of radiating elements may be positioned such that each radiating element of the first radiating board is aligned with corresponding one of the radiating elements of the second radiating board. The first and second sets of radiating elements cooperatively define the array of radiating dipoles (e.g., 2×4 array of dipoles, etc.). The radiating elements may be configured to radiate radio frequency (RF) energy omnidirectionally.

RF energy may enter the antenna assembly through a connector (e.g., N-connector, etc.) connected to a transmission or communication line or link (e.g., a coaxial cable, etc.). Interconnect boards are used to move RF energy from the network board to the radiating dipoles of the first and second radiating boards. Each interconnect board may be used to electrically connect a corresponding pair of the radiating elements of the first and second radiating boards. The antenna components may be enclosed within a radome, such as a cylindrical radome (e.g., 118, etc.) having a length of 15 inches (381 millimeters) or less, a cylindrical radome (e.g., 218, etc.) having a length of 8 inches (203.2 millimeters) or less, etc.

In some exemplary embodiments, the antenna assembly includes only four interconnecting boards and only four dipole type radiating elements on each of the first and second radiating boards. The radiating elements may be operable to co-locate RF currents for both the 2.4 GHz band and the 5 GHz band. The radiating elements may be operable simultaneously for both the 2.4 GHz band and the 5 GHz band. Accordingly, RF currents for the 2.4 GHz band and RF currents for the 5 GHz band may be co-located on each of the radiating elements.

In an exemplary embodiment (e.g., antenna assembly 100, etc.), each radiating element is operable as a typical single dipole element for the 2.4 GHz band, such that the radiating elements are collectively operable as or similar to an array of four radiating dipoles. But for the 5 GHz band, each radiating element is operable as two separate dipole-like elements separated by a slot or distance. The radiating elements are thus collectively operable as or similar to an array of eight dipoles for the 5 GHz band. Accordingly, this exemplary embodiment includes or co-locates a four dipole-like 2.4 GHz array with an eight dipole-like 5 GHz array where both arrays are defined by or use the same radiating elements, i.e., the first set of four radiating elements of the first radiating board and the second set of four radiating elements of the second radiating board.

In another exemplary embodiment (e.g., antenna assembly 200, etc.), an antenna assembly includes a four dual band dipole array along each side of a network board, which is also operable as a reflector. Each dual band dipole may be operable such that RF currents for both the 2.4 GHz band and the 5 GHz band are co-located on each dual band dipole. In this example, each array is operable simultaneously and co-locates a 4 dipole-like 2.4 GHz array with a 4 dipole-like 5 GHz array. Also in this example, each array includes four dual band dipoles that may be co-located very close to each other. For example, the dual band dipoles may be less than one wavelength apart at high band (e.g., one wavelength apart for the 5 GHz band, one wavelength apart at a frequency of 5.9 GHz, spaced apart by about 2 inches (about 5.08 centimeters) or less, etc.), Due to the close spacing of the dipoles (e.g., about 2 inches apart or less, etc.), the sidelobes are relatively small. And, the small sidelobes help prevent radiating power from going in unwanted directions.

Figure 4:
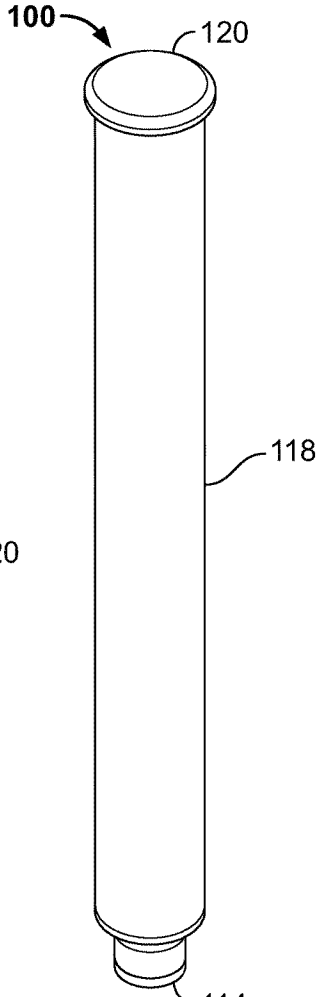
FIG. 4 is another perspective view of the antenna assembly shown in FIG. 3.

FIGS. 1 through 4 illustrate an exemplary embodiment of a multi-band omnidirectional antenna assembly 100 embodying one or more aspects of the present disclosure. As shown, the antenna assembly 100 includes a network board 102 having a first or upper side and a second or lower side. The first side of the network board 102 includes a feed network comprised of one or more microstrip lines 104 (broadly, one or more transmission or communication lines or links). The second side includes a ground plane 124 (e.g., electrically-conductive laminate, etc.) as shown in FIG. 5C.

As shown in FIG. 2, a first radiating board 106 is approximately parallel to the network board 102 and spaced apart from the first side of the network board 102. A second radiating board 108 is located approximately parallel to the network board 102 and spaced apart from the second side of the network board 102.

Each radiating board 106, 108 has at least one dipole or dipole radiating element 110 (broadly, radiating element). In this example, the first radiating board 106 includes a first set or array of only four dipole radiating elements 110 spaced apart along (e.g., equally spaced apart, etc.) the upper side of the first radiating board 106. Also in this example, the second radiating board 108 includes a second set or array of only four dipole radiating elements 110 spaced apart along (e.g., equally spaced apart, etc.) the lower side of the second radiating board 108.

The antenna assembly 100 also includes one or more interconnect or interconnecting boards 112. The interconnect boards 112 are operable to provide an electrical connection between the feed network of the network board 102 and the radiating elements 110 of the radiating boards 106, 108. In this illustrated example embodiment shown in FIGS. 1 and 2, the antenna assembly 100 includes only four interconnecting boards 112 and only four dipole radiating elements 110 on each of the radiating boards 106, 108. Alternative embodiments may include different configurations of interconnecting boards and/or dipole radiating elements, such as more or less than four, other sizes, other shapes, non-linear arrays, antenna elements or radiators that are not in an array, etc.

The network board 102 may be coupled to a connector 114. The connector 114 may be configured to connect to a transmission or communication line or link (e.g., coaxial cable, etc.) for sending and/or receiving signals between the antenna assembly 100 and an antenna signal source. RF energy may enter and leave the antenna assembly 100 through the connector 114. In this example, the connector 114 is illustrated as an N-connector for connection to a coaxial cable, but other suitable connectors may also be used.

The connector 114 may be coupled to the network board 102 using a semi-rigid cable 116. Other suitable coupling elements may also be used to couple the network board 102 to the connector 114.

Figure 3:
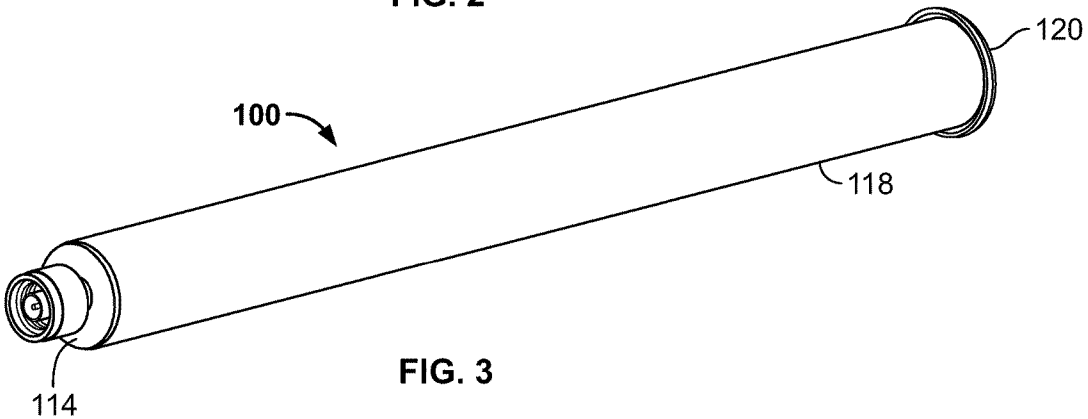
FIG. 3 is a perspective view of the antenna assembly shown in FIG. 1 after being fully assembled and also showing the radome.

The antenna assembly 100 includes a radome 118. The radome 118 may have a cylindrical shape and a length of 15 inches (381 millimeters) or less. The radome 118 may include a radome cap 120 coupled to a first end of the radome 118. The second end of the radome 118 may be coupled to the connector 114. As shown by FIGS. 2, 3, and 4, the radome 118 may be used to house, enclose, and protect the antenna components from the environment. The network board 102, radiating boards 106, 108, and interconnect boards 112 may be positioned within and enclosed in an internal space or cavity defined by the radome 118, radome cap 120, and connector 114.

Figure 5A:
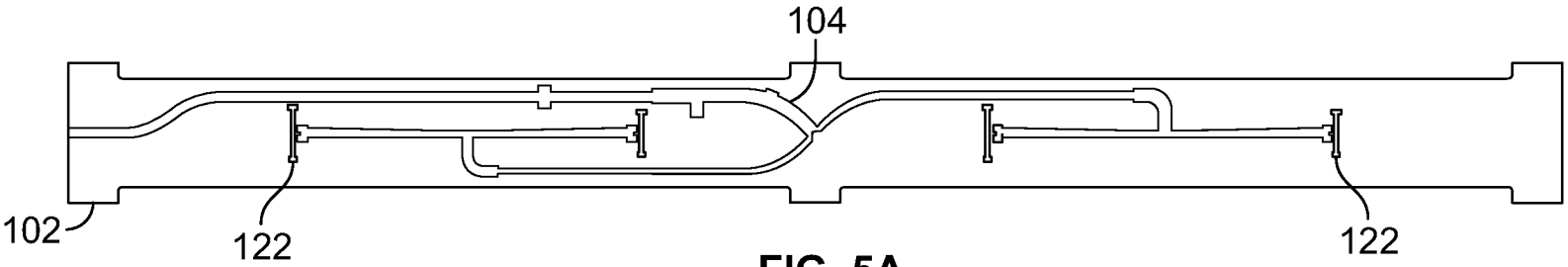
FIG. 5A is a top view of the network board shown in FIG. 1, and illustrating microstrip lines along a top of the network board according to this exemplary embodiment.
Figure 5B:
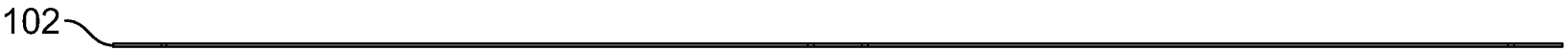
FIG. 5B is a side view of the network board shown in FIG. 5A.
Figure 5C:
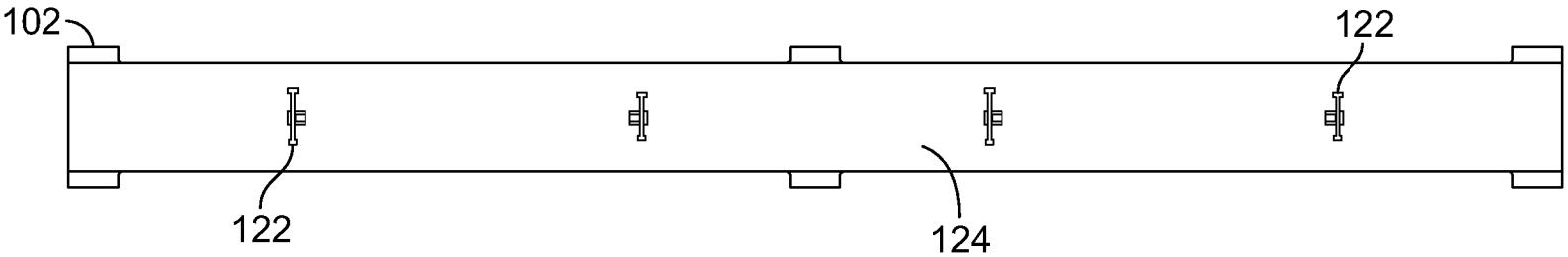
FIG. 5C is a bottom view of the network board shown in FIG. 5A, and illustrating an electrically-conductive laminate (ground plane) along a bottom of the network board according to this exemplary embodiment.

FIGS. 5A, 5B, and 5C respectively show the top, side, and bottom of the network board 102. As shown in FIG. 5A, the first or top side of the network board 102 includes microstrip lines 104. The microstrip lines 104 may be used to transfer radio frequency (RF) energy between the connector 114 and interconnect boards 112. In turn, the interconnect boards 112 may be used to transfer RF energy between network board 102 and the dipole radiating elements 110 on the radiating boards 106, 108.

Figure 1:
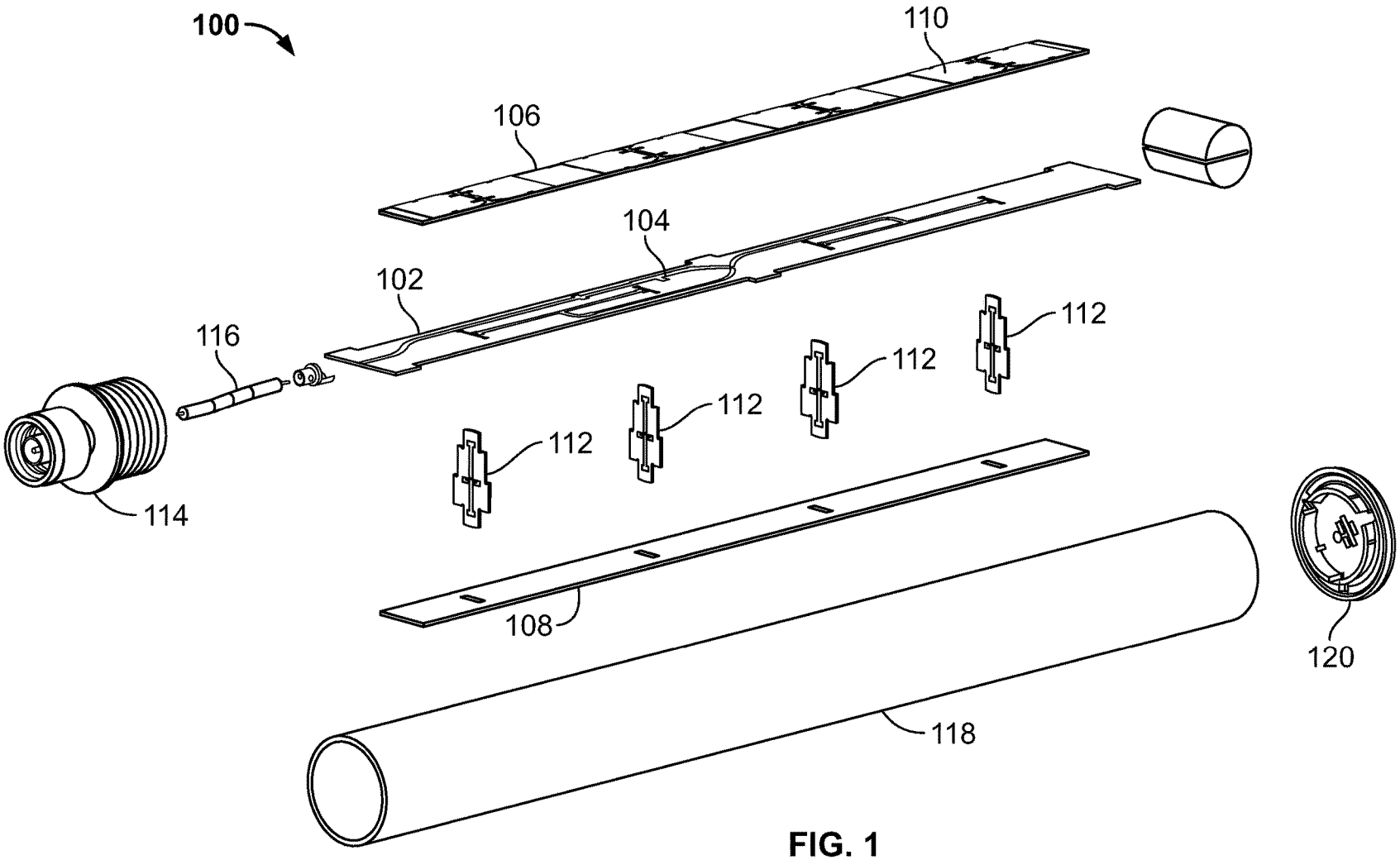
FIG. 1 is an exploded perspective view of an antenna assembly according to an exemplary embodiment.

The microstrip lines 104 may cover a portion of the first side of the network board 102 and may comprise any suitable material for providing an electrical connection, such as, for example, a printed circuit board (PCB), conductive metal, electrically-conductive traces, etc. The microstrip lines 104 may provide an electrical connection path between the connector 114 and each interconnect board 112, which may create as many microstrip line paths as interconnect boards 112. The network board 102 may include one or more slots 122 for receiving the interconnect boards 112. In this example embodiment, the network board 102 includes four slots 122. Each slot 122 is configured for receiving therethrough a portion of a corresponding one of the four interconnect boards 112 as shown by FIGS. 1 and 2. The microstrip lines 104 may provide a path from each slot 122 to the connector 114. Although one example microstrip line configuration is illustrated in FIG. 5A, other configurations, other feeds, or transmission line types may also be used.

As shown by FIG. 5C, the second or bottom side of the network board 102 includes a ground plane 124. The ground plane 124 may cover a portion, substantially all, or the entirety of the second side of the network board 102. The ground plane 124 may comprise any suitable material for creating a grounding plane for the antenna assembly 100, such as, for example, an electrically-conductive laminate, an electrically-conductive metal, etc.

Figures 6A, 6B, 6C:
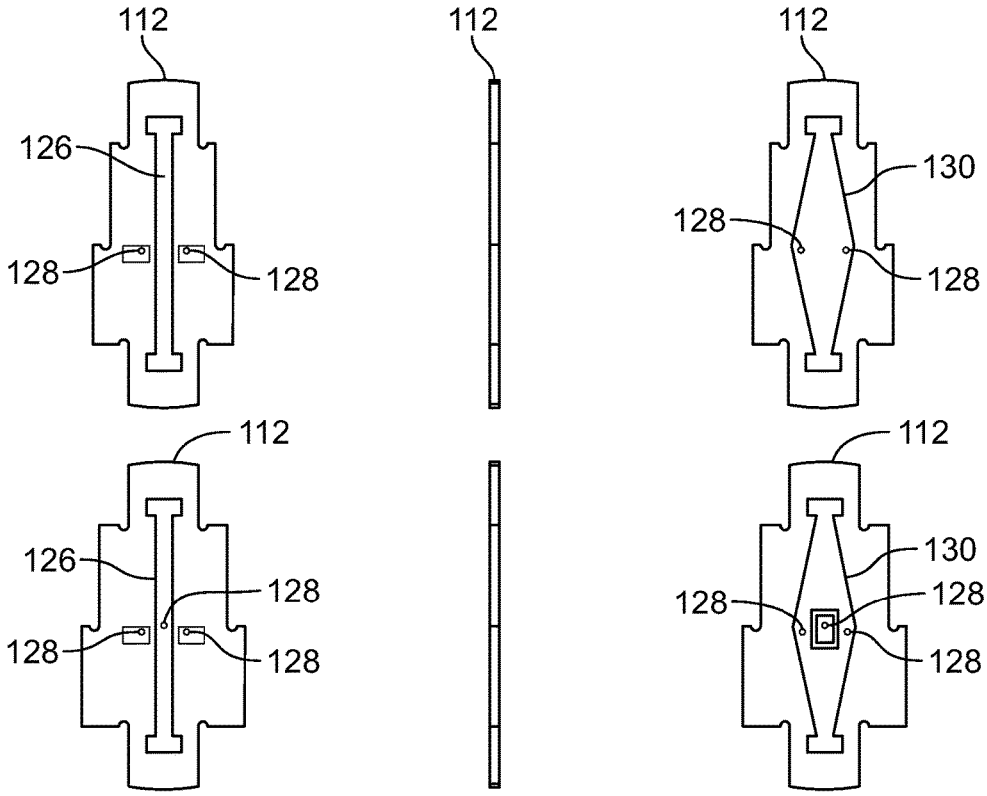
FIG. 6A is a front view of two of the four interconnect boards shown in FIG. 1, and illustrating microstrip lines and vias along the front sides of the interconnect boards according to this exemplary embodiment.
FIG. 6B is a side view of the two interconnect boards shown in FIG. 6A.
FIG. 6C is a back view of the two interconnect boards shown in FIG. 6A, and illustrating a ground plane and vias along the back sides of the interconnect boards according to this exemplary embodiment.

FIGS. 6A, 6B, and 6C respectively show the front, side, and back of two of the four interconnect boards 112. As shown in FIG. 6A, the interconnect boards 112 include microstrip lines 126 (broadly, more transmission or communication lines or links) along the front sides. As shown in FIG. 6C, the interconnect boards 112 include a ground 130 (e.g., a tapered ground plane, a diamond-shaped ground plane, etc.) along the back sides.

The interconnect board microstrip lines 126 may be used to move RF energy from the network board 102 to the radiating boards 106, 108. Each microstrip line 126 of the interconnect boards 112 may be electrically coupled to a corresponding portion of the microstrip lines 104 of the network board 102, to thereby provide a path from the interconnect board microstrip lines 126 to the connector 114. The microstrip line 126 of each interconnect board 112 may be electrically coupled to the radiating boards 106, 108 at each end of the interconnect board microstrip line 126. The interconnect board microstrip lines 126 are electrically coupled to corresponding ones of the dipole radiating elements 110 of the radiating boards 106, 108 at each end portion of the interconnect board microstrip line 126. The interconnect board microstrip line 126 may be approximately symmetrical to provide equal (or substantially equal) amounts of RF energy to each radiating board 106, 108. Although FIGS. 6A-C illustrate example configurations of the interconnect boards 112, microstrip lines 126, and ground 130, other configurations, other feeds, other transmission line types, etc. may also be used.

The microstrip lines 126 may cover a portion of one or both sides of the corresponding interconnect board 112. The microstrip lines 126 of the interconnect boards 112 may comprise any suitable material for providing an electrical connection, such as, for example, a PCB, conductive metal, electrically-conductive trace, etc.

As shown in FIGS. 6A and 6C, the interconnect boards 112 include vias 128 extending through the interconnect boards 112 from the front side (FIG. 6A) to the back side (FIG. 6C). With reference to FIG. 1, the first and third interconnect boards 112 (first and third closest to the connector 114) include three vias 128 as also shown for the lower interconnect board 112 in FIGS. 6A and 6C. The second and fourth interconnect boards 112 (second and fourth closest to the connector 114) include two vias 128 as also shown for the upper interconnect board 112 in FIGS. 6A and 6C.

In this example, the vias 128 provide electrical connection from the ground plane 130 of the interconnected board to the ground plane 124 of network board. The ground level may be exactly in the middle between radiating elements 110. A signal at the ground level may be divided symmetrically and reach the radiating elements 110 at the two sides of the ground plane 124 at or at about the same time. The ground currents of the network board may be moved from the vias connection to the interconnect board microstrip ground 130 (at which point the signal may then split up and down).

In exemplary embodiments, the feed from the network board 102 to the interconnected boards 112 may be constructed or configured in a way that is perfectly symmetric, such that the feed point is exactly at the center of the interconnecting vertical microstrip line 126 of the interconnect boards 112. This symmetric feed results in same phase currents at the two dipole elements 110 above and below the network board 102. The same current phase in the radiating (dipole) elements 110 ensures low ripple in the azimuth plane radiation in these exemplary embodiments.

The tapered shape of the ground side 130 of the interconnected board 112 also functions as a balun. It gracefully transitions the RF currents from the unbalanced microstrip line 126 to the balanced dipole radiating elements 110.

Figure 7A:
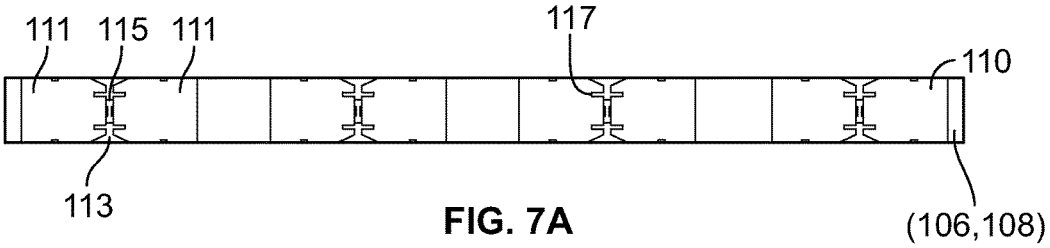
FIG. 7A is a plan view of one of the two radiating boards shown in FIGS. 1 and 2, and illustrating an array of radiating dipoles spaced apart along the board according to this exemplary embodiment.
Figure 7B:
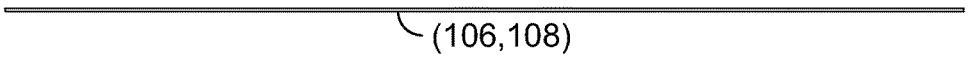
FIG. 7B is a side view of the radiating board shown in FIG. 7A.

As shown in FIG. 7A, each radiating board 106, 108 includes an array of four dipole radiating elements 110 spaced apart along (e.g., equally spaced apart, etc.) along a side of the board 106, 108. The dipole radiating elements 110 cover a portion of one side of the radiating boards 106, 108. The dipole radiating elements 110 may comprise any suitable material for radiating RF energy, such as, for example, PCB traces, electrically-conductive metal, etc. The radiating boards 106, 108 include slots 115 for receiving corresponding end portions of the interconnect boards 112.

A slot or thru-hole 115 is located adjacent to each dipole radiating element 110 at the middle of each radiating dipole 110 between the first and second spaced-apart portions or legs 111 of the dipole radiating element 110, etc.

Figure 8:
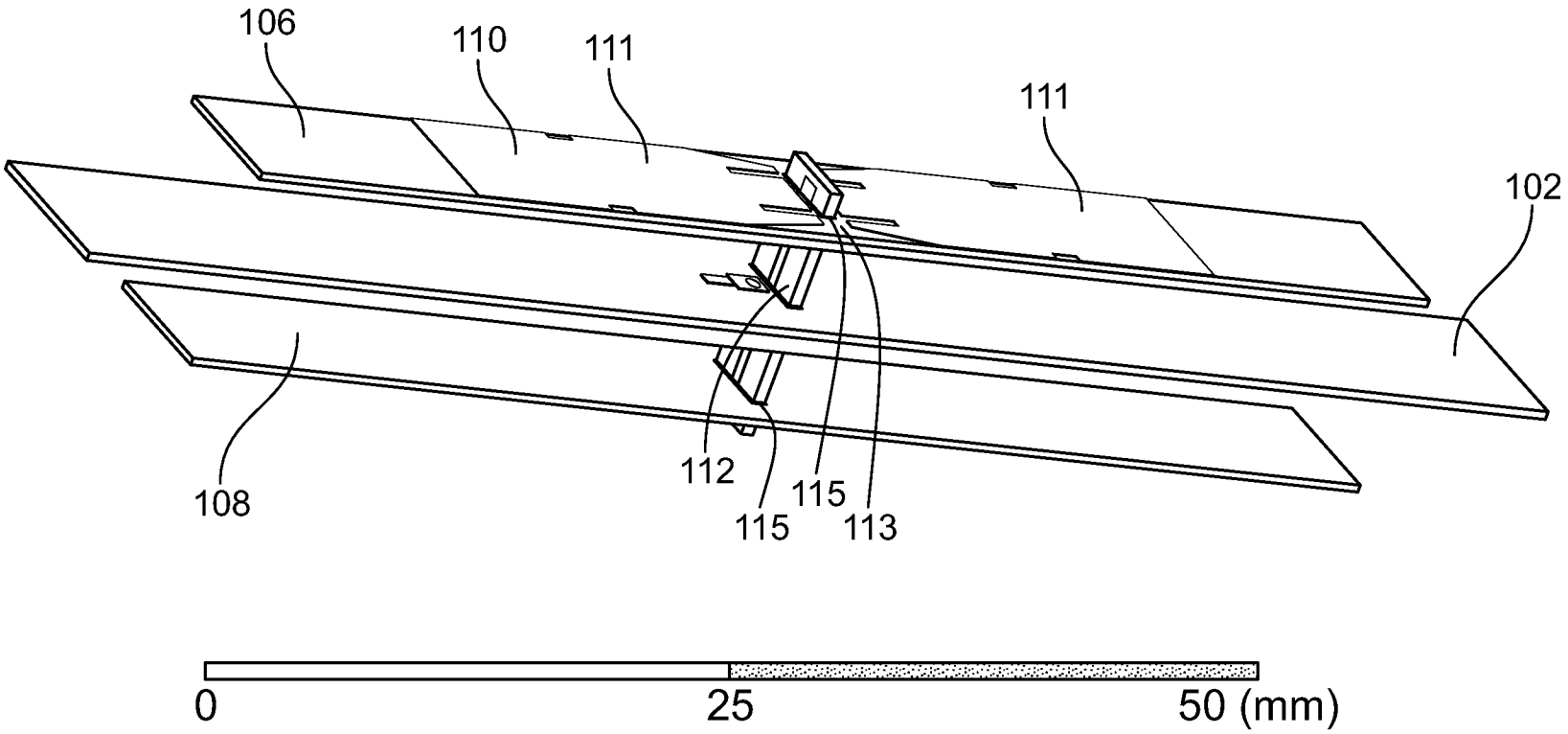
FIG. 8 is an upper perspective view of a portion of the antenna assembly shown in FIG. 2, and illustrating an interconnect board, a network board, two dipole or radiating boards, and a dipole on the top of the upper board according to this exemplary embodiment, where the 0 to 50 millimeter (mm) scale is shown for purpose of illustration only.
Figure 9:
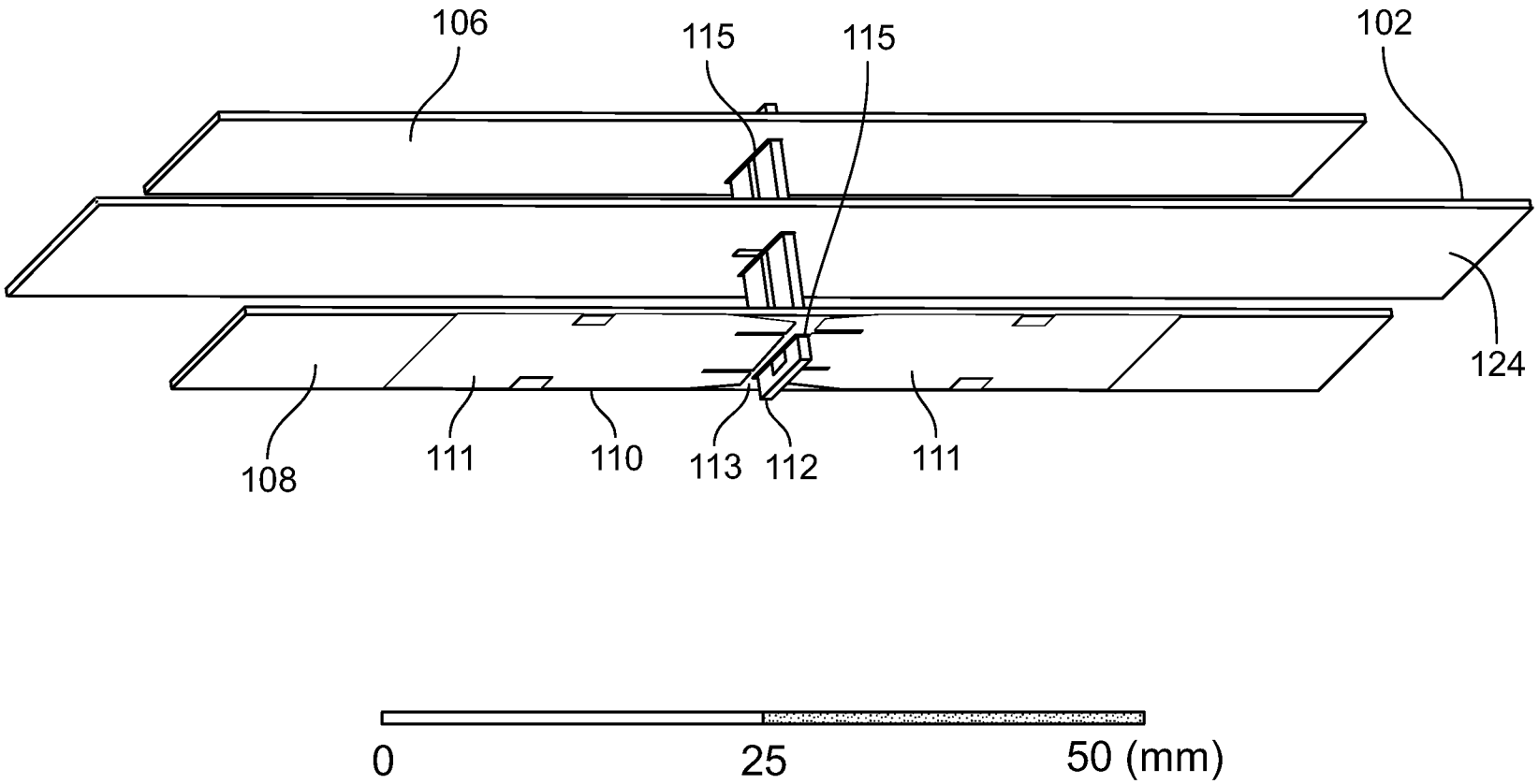
FIG. 9 is a lower perspective view of the portion of the antenna assembly shown in FIG. 8, and further illustrating a dipole on the bottom of the lower board and an electrically-conductive laminate (ground plane) along a bottom of the network board according to this exemplary embodiment, where the 0 to 50 mm scale is shown for purpose of illustration only.

The first and second spaced-apart portions or legs 111 of each dipole 110 are spaced apart by a slot or gap 113. For the dipole 110 shown in FIG. 8, the dipole legs or portions 111 are on opposite sides of the upper end portion of the interconnect board 112, which is received through the slot 115 in the board 106. For the dipole 110 shown in FIG. 9, the dipole legs or portions 111 are on opposite sides of the lower end portion of the interconnect board 112, which is received through the slot 115 in the board 108. The electrically-conductive laminate 124 (broadly, ground plane) is along the bottom of the network board 102. The electrically-conductive laminate 124 may act as a reflector for each dipole 110 and may be located approximately an equal distance from each dipole 110. The dipole radiating elements 110 may radiate omnidirectionally in the Z-Y plane during operation of the antenna assembly 100. The 0 to 50 millimeter (mm) scale shown at the bottom of FIGS. 8 and 9 is for purpose of illustration only, as other embodiments may include larger or smaller antenna components.

Figure 10:
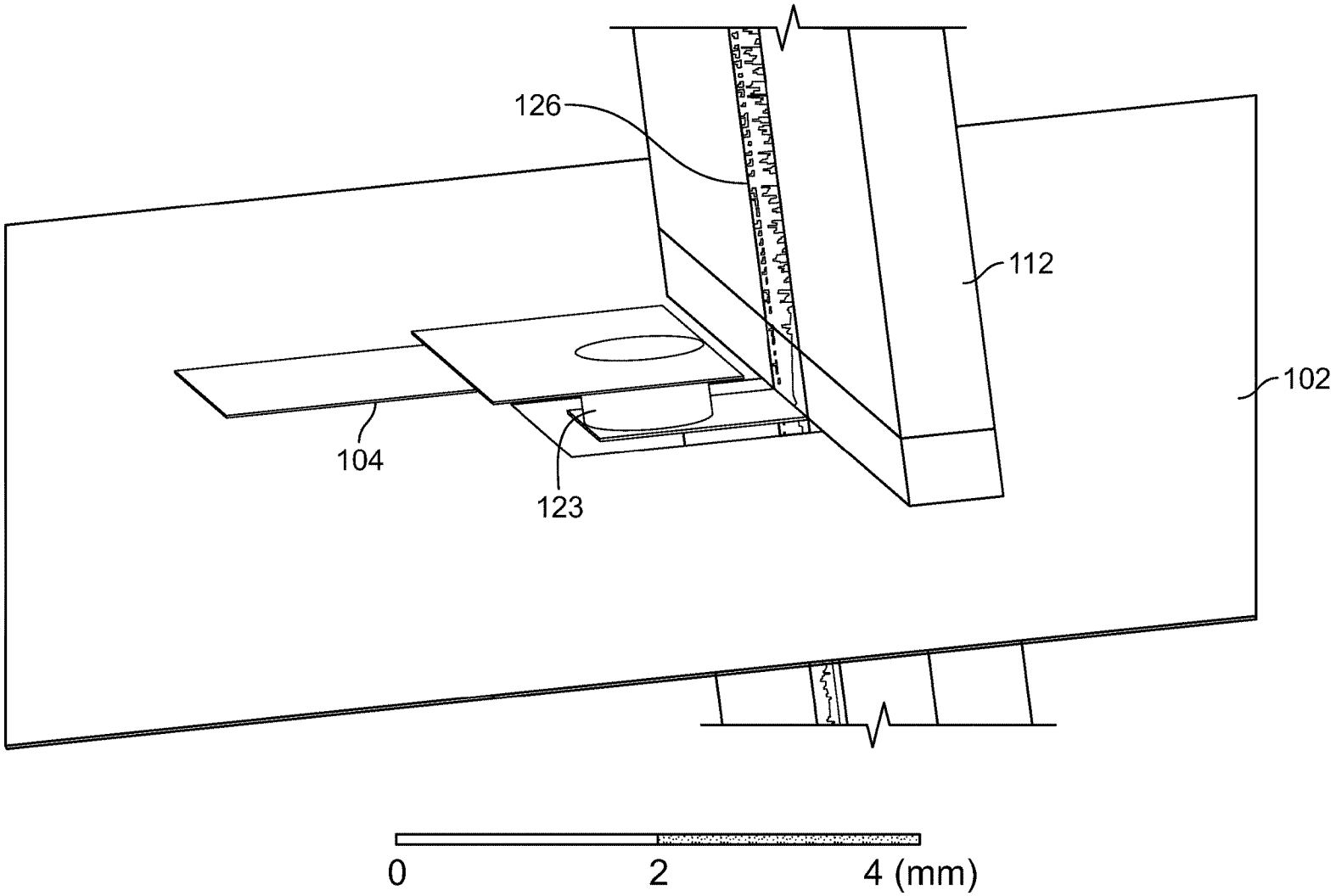
FIG. 10 is an upper perspective view showing a portion of the interconnect board and network board of the antenna assembly shown in FIG. 2, and illustrating an exemplary way of connecting the microstrip lines of the network board and interconnect board according to this exemplary embodiment, where the 0 to 4 mm scale is shown for purpose of illustration only.

FIG. 10 shows an exemplary way of connecting the microstrip lines of the network board 102 and interconnect boards 112 according to this exemplary embodiment. As shown, the network board 102 includes via 123. The feeding structure from the network board's microstrip lines 104 to the interconnect board's microstrip lines 126 may ensure or provide symmetrical feeding of each dipole 110 from the network's microstrip lines 104.

FIG. 11 is a side view of a portion of the antenna assembly shown in FIG. 2, and illustrating how a four dipole-like 2.4 GHz array may be co-located with an eight dipole-like 5 GHz array in this exemplary embodiment. FIG. 12 is a top view of one of the dipoles or radiating elements 110 shown in FIG. 11. In FIGS. 11 and 12, the arrows indicate radiating currents for the 2.4 GHz band and 5 GHz band that are co-located on the radiating elements 110. In FIG. 12, a single set of three arrows 125 extends across the entire radiating element 110, which indicates that the radiating element 110 is operable as a typical single dipole element for the 2.4 GHz band. For the 5 GHz band, however, the radiating element 110 is operable as two separate dipole-like elements separated by a distance as indicated by the two separate sets 127 of three arrows. One set of three arrows is on the left dipole portion or leg 111, while the other set of three arrows is on the right dipole portion or leg 111. In FIGS. 11 and 12, only the radiating currents are indicated because the radiating currents determine the radiation performance. The slot currents are not shown in FIGS. 11 and 12 for the 5 GHz band, but they are shown in FIG. 15 discussed below.

With continued reference to FIGS. 11 and 12, the antenna assembly includes only four interconnecting boards 112 and only four dipoles or radiating elements 110 on each radiating board. RF currents for both the 2.4 GHz band and the 5 GHz band are co-located on each radiating element 110. Each radiating element 110 is operable simultaneously for both the 2.4 GHz band and the 5 GHz band. For the 2.4 GHz band, each radiating element 110 is operable as a typical single dipole element. But for the 5 GHz band, each radiating element 110 is operable as two separate dipole-like elements or legs 111 separated by the slot or distance 113. The network of the antenna assembly 100 may be simplified and take up much less space as compared to the network required for the conventional antenna shown in FIG. 13. Thus, the length of the radome 118 (e.g., 15 inches or 381 millimeters, etc.) can be reduced considerably as compared to the radome length (e.g., 27½ inches to 31½ inches or 700 to 800 millimeters, etc.) required for the conventional antenna shown in FIG. 13.

For the exemplary embodiment shown in FIG. 11, the antenna assembly includes only four interconnecting boards 112 and only four dipoles or radiating elements 110 on each radiating board. This is significantly less than the conventional antenna shown in FIG. 13, which requires twelve interconnecting boards 12 and twelve different radiating elements 10 on each side. This conventional antenna includes an array 3 of four dipole radiating elements for the low band (2.4 GHz band) and another array 5 of eight dipole radiating elements for the high band (5 GHz band). The arrays 3, 5 are spaced apart from each other and do not use or rely upon the same radiating elements 10. In FIG. 13, the arrows indicate radiating currents at 2.4 GHz and 5 GHz, which are not co-located as in FIGS. 11 and 12. Instead, FIG. 13 shows the radiating currents at 2.4 GHz and 5 GHz separated or isolated from each other as the low band radiating currents are located on or confined to the array 3 of four dipoles (on the right hand side of FIG. 13), whereas the high band radiating currents are located on or confined to the array 5 of eight dipoles (on the left hand side of FIG. 13).

With its twelve interconnect boards 12 and twelve radiating elements 10 on each side, the length of the conventional antenna is very large especially when configured to have omnidirectional patterns in the azimuth plane. For example, the conventional antenna may have a length of 27½ inches to 31½ inches (700 to 800 millimeters). The network board 2 is also very complex for this conventional antenna. For example, a special circuit or diplexer is required to combine the 2.4 GHz signals with the 5 GHz signals. The network board 2 takes up a lot of space because there are twelve total signals coming to the network board 2 that have to be combined. The network board 2 thus has to be relatively long, such that the antenna length is very large for the conventional antenna of FIG. 13 as compared to the antenna assembly of FIGS. 11 and 12.

FIG. 14 shows an example current flow (as indicated by arrows) in a dipole radiating element 110 of the antenna assembly 100 shown in FIG. 2 when the dipole 110 is operated at a frequency of about 2.5 GHz. The currents in this frequency band may be typical of a ½ lambda dipole. The dipole radiating element 110 includes first and second portions or legs 111, which are spaced apart in the center by the slot or gap 113. The currents may flow in the same direction (e.g., parallel to or toward the direction of polarization) along each portion 111 of the dipole radiating element 110. Although one example dipole configuration is illustrated in FIG. 14, other suitable dipole configurations may be used.

FIG. 15 shows the current flow (as indicated by arrows) in the dipole radiating element 110 of the antenna assembly 100 shown in FIG. 2 when the dipole is operated at a frequency of about 5.5 GHz. The dipole radiating element 110 includes four dipole slots 117 near the center of the dipole radiating element 110, with two dipole slots 117 along each portion 111 of the dipole 110. Each dipole slot 117 is oriented substantially parallel to the polarization direction. Although one example dipole slot configuration is illustrated in FIG. 15, other suitable slot configurations may be used. The currents in the 5 GHz frequency band may resemble a second mode of radiation of the dipole 110 of about one wavelength long. At the 5 GHz band, there may be two types of currents present or flowing in the dipole 110, which are slot currents 119 and same direction currents 121. The slot currents 119 flow around the dipole slots 117 in the dipole 110. The same direction currents 121 flow in the same direction (e.g., parallel to or toward the direction of polarization) along each portion 111 of the dipole 110. The slot currents 119 present at a frequency of about 5.5 GHz may not contribute significantly to radiation because their contributions may be cancelled in the far-field zone. But the same direction currents 121 may constructively contribute to provide the same polarization fields in the far-field zone. Without the slot currents 119, the impedance of the radiating dipoles at the high band may be very far away from a reasonable value of, for example, 50 ohms.

FIG. 16 is an example circuit model for the dipole radiating element 110 illustrated in FIG. 14 when the dipole 110 is operated at a frequency of about 2.5 GHz. The model may represent a typical ½ wavelength dipole at 2.5 GHz.

FIG. 17 is an example circuit model for the dipole radiating element 110 illustrated in FIG. 15 when the dipole 110 is operated at a frequency of about 5.5 GHz. Each dipole slot 117 may be modeled as an inductor 131 that raises the current at the base of the dipole 110 to match its impedance to the microstrip line impedance of the interconnect board 112. The currents responsible for radiation may be similar to currents that appear in a half wave dipole, which take about one-half wavelength on each dipole leg (e.g., see the set of three arrows on each dipole leg 111 in FIGS. 11 and 12, etc.). The overall current distribution at 5 GHz on one dipole leg is about ⅝ wavelengths long, and includes the one-half wavelength radiating currents and the additional slot currents. The additional slot currents do not contribute substantially to radiation. But the extended current path provided by the slot currents raises the current level substantially to bring impedance at the feed point of each dipole leg close to 50 ohms.

The combination of ground plane 124 (that acts as reflector to the dipoles 110 at both sides of the boards 102) and the array factor of dipoles 110 at both sides of board 102, create an omnidirectional radiation pattern in the plane perpendicular to the axis of antenna (that is, the azimuth plane where theta=90 degrees).

Using the same dipole radiating elements 110 for multiple frequency bands allows less dipole radiating elements 110 to be used in the antenna assembly 100. The size of the network may also be reduced to allow for a smaller antenna. The distribution of currents on the dipole radiating elements 110 may allow the array to have high gain (e.g., greater than seven dBi, etc.) and low radiation ripple (e.g., less than two decibels, etc.) without large grating lobes in the 5 GHz band in the elevation plane.

FIGS. 18 through 23 provide analysis results measured for a physical prototype of the antenna assembly 100 including the radome 118 shown in FIGS. 1 through 4. These analysis results are provided only for purposes of illustration and not for purposes of limitation.

FIG. 18 is an exemplary line graph of the voltage standing wave ratio (VSWR) versus frequency (GHz) measured for the physical prototype of the antenna assembly 100 including the radome 118. The VSWR may be lower because of a wide dipole shape that may allow approximately constant impedance versus frequency.

FIG. 19 is an exemplary line graph of the peak gain in decibels relative to isotropic (dBi) versus frequency (MHz) measured for the physical prototype of the antenna assembly 100 including the radome 118. The measured radiating gain may average about eight dBi. Accordingly, the antenna assembly 100 may thus provide the benefit of high gain within limited real estate and have a compact size.

FIG. 20 is an exemplary line graph of the ripple in decibels versus frequency (MHz) measured for the physical prototype of the antenna assembly 100 including the radome 118. The radiating ripple may be very low, such as, for example, less than about two decibels.

FIG. 21 shows the pattern orientation and planes relative to a prototype antenna during radiation pattern testing. FIG. 22 illustrates radiation patterns (Theta 90°, Phi 0°, and Phi 90° plane) measured for the physical prototype of the antenna assembly 100 including the radome 118 at a frequency of about 2450 MHz. FIG. 23 illustrates radiation patterns (Theta 90°, Phi 0°, and Phi 90° plane) measured for the physical prototype of the antenna assembly 100 including the radome 118 at a frequency of about 5500 MHz. Generally, FIGS. 22 and 23 show that the example antenna assembly 100 may provide excellent azimuth radiation patterns with very little ripple in the horizon, and may provide clean elevation patterns with the beam steady at horizon. Accordingly, the antenna assembly 100 may thus provide the benefit of omnidirectional patterns with low ripple, which benefit may be obtained from the distinct structure in having a combination of network reflector and the array factor of dipoles on each side of network board.

FIGS. 24 through 26 illustrate another exemplary embodiment of a multi-band omnidirectional antenna assembly 200 embodying one or more aspects of the present disclosure. As shown, the antenna assembly 200 includes a network board 202 having a first or upper side and a second or lower side. The first side of the network board 202 includes a feed network (e.g., a microstrip network printed on the board 202, etc.) comprised of one or more microstrip lines 204 (broadly, one or more transmission or communication lines or links). The second side includes a ground plane 224 (e.g., electrically-conductive laminate, etc.) as shown in FIG. 29.

As shown in FIG. 25, a first radiating board 206 is approximately parallel to the network board 202 and spaced apart from the first side of the network board 202. A second radiating board 208 is located approximately parallel to the network board 202 and spaced apart from the second side of the network board 202.

Each radiating board 206, 208 has at least one dipole or dipole radiating element 210 (broadly, radiating element). In this example, the first radiating board 206 includes a first set or array of only four dipole radiating elements 210 spaced apart along (e.g., equally spaced apart, etc.) the upper side of the first radiating board 206. Also in this example, the second radiating board 208 includes a second set or array of only four dipole radiating elements 210 spaced apart along (e.g., equally spaced apart, etc.) the lower side of the second radiating board 208.

The antenna assembly 200 also includes one or more interconnect or interconnecting boards 212. The interconnect boards 212 are operable to provide an electrical connection between the feed network of the network board 202 and the radiating elements 210 of the radiating boards 206, 208. In this illustrated example embodiment shown in FIGS. 24 and 25, the antenna assembly 200 includes only four interconnecting boards 212 and only four dipole radiating elements 210 on each of the radiating boards 206, 208. Alternative embodiments may include different configurations of interconnecting boards and/or dipole radiating elements, such as more or less than four, other sizes, other shapes, non-linear arrays, antenna elements or radiators that are not in an array, etc.

The network board 202 may be coupled to a connector 214. The connector 214 may be configured to connect to a transmission or communication line or link (e.g., coaxial cable, etc.) for sending and/or receiving signals between the antenna assembly 200 and an antenna signal source. RF energy may enter and leave the antenna assembly 200 through the connector 214. In this example, the connector 214 is illustrated as an N-connector for connection to a coaxial cable, but other suitable connectors may also be used.

The connector 214 may be coupled to the network board 202 using a semi-rigid cable 216 and a choke 234. The choke 234 is operable for helping increase bandwidth of the antenna assembly 200. Other suitable coupling elements may also be used to couple the network board 202 to the connector 214.

The antenna assembly 200 includes a radome 218. The radome 218 may have a cylindrical shape and a length of 8 inches (203.2 millimeters) or less. The radome 218 may include a radome cap 220 coupled to a first end of the radome 218. A sleeve 238 (e.g., metal cylindrical sleeve, etc.) is coupled to a second end of the radome 218. A collar or component 242 (e.g., metallic collar, etc.) provides a mechanical interface or mechanical coupling between the connector 214 and the radome 218, e.g., for mechanical integrity. The sleeve 238 acts as intermediary mechanical interface between collar 242 and radome 218. An element 246 (e.g., foam pad, etc.) is positioned on an end portion of the network board 202 to help stabilize and hold the antenna components in place within the radome 218 and/or inhibit vibrations during travel.

As shown by FIGS. 25 and 26, the radome 218 may be used to house, enclose, and protect the antenna components from the environment. The network board 202, radiating boards 206, 208, and interconnect boards 212 may be positioned within and enclosed in an internal space or cavity defined by or between the radome 218, radome cap 220, sleeve 238, and connector 214.

The first or top side of the network board 202 includes microstrip lines 204 as shown in FIG. 24. The microstrip lines 204 may be used to transfer radio frequency (RF) energy between the connector 214 and interconnect boards 212. In turn, the interconnect boards 212 may be used to transfer RF energy between network board 202 and the dipole radiating elements 210 on the radiating boards 206, 208. The microstrip lines 204 of the network board 202 may be operable or used to divide the input power to the radiating elements 210 via the interconnected boards 212. The microstrip lines 204 of the network board 202 may be specially designed or configured to be matched simultaneously on both the low and high band, such that the VSWR in the connector 214 is below 2:1 at both the low and high bands simultaneously.

The microstrip lines 204 may cover a portion of the first side of the network board 202 and may comprise any suitable material for providing an electrical connection, such as, for example, a printed circuit board (PCB), conductive metal, electrically-conductive traces, etc. The microstrip lines 204 may provide an electrical connection path between the connector 214 and each interconnect board 212, which may create as many microstrip line paths as interconnect boards 212. The network board 202 may include slots 222 for receiving the corresponding interconnect boards 212. In this illustrated embodiment, the network board 202 includes four slots 222. Each slot 222 is configured for receiving therethrough a portion of a corresponding one of the four interconnect boards 212 as shown by FIGS. 24 and 25. The microstrip lines 204 may provide a path from each slot 222 to the connector 214. Although one example microstrip line configuration is illustrated in FIG. 24, other configurations, other feeds, or transmission line types may also be used.

As shown by FIG. 29, the second or bottom side of the network board 202 includes a ground plane 224. The ground plane 224 may cover a portion, substantially all, or the entirety of the second side of the network board 202. The ground plane 224 may comprise any suitable material for creating a grounding plane for the antenna assembly 200, such as, for example, an electrically-conductive laminate, an electrically-conductive metal, etc.

In an exemplary embodiment, the interconnect boards 212 of the antenna assembly 200 may be identical or substantially similar to the interconnect boards 112 of the antenna assembly 100. Accordingly, the interconnect boards 212 may have the same configuration as the interconnect boards 112 as described herein and shown in FIGS. 6A, 6B, and 6C. In which case, the interconnect boards 212 may include microstrip lines (broadly, more transmission or communication lines or links) along the front sides and a ground (e.g., a tapered or diamond-shaped ground plane printed on the board, etc.) along the back sides. The interconnect boards 212 may also include vias extending through the interconnect boards 212 from the front side to the back side. Although FIGS. 6A, 6B, and 6C illustrate example configurations that may be used for the interconnect boards 212, microstrip lines, ground, and vias, other configurations, other feeds, or transmission line types may also be used.

The interconnect boards 212 may be used to transfer RF energy or power from the network board 202 to the radiating elements 210 of the radiating boards 206, 208. The interconnect boards 212 may be configured to act or operate as a "balun" and help to ensure a smooth transition from the unbalanced microstrip line 204 on the network board 212 to the balanced load of a dipole 210.

Each microstrip line of the interconnect boards 212 may be electrically coupled to a corresponding portion of the microstrip lines of the network board 202, to thereby provide a path from the interconnect board microstrip lines to the connector 214. The microstrip line of each interconnect board 212 may be electrically coupled to the radiating boards 206, 208 at each end of the interconnect board microstrip line. The interconnect board microstrip lines are electrically coupled to corresponding ones of the dipole radiating elements 210 of the radiating boards 206, 208 at each end portion of the interconnect board microstrip line. The interconnect board microstrip line may be approximately symmetrical to provide equal (or substantially equal) amounts of RF energy to each radiating board 206, 208.

The microstrip lines may cover a portion of one or both sides of the corresponding interconnect board 212. The microstrip lines of the interconnect boards 212 may comprise any suitable material for providing an electrical connection, such as, for example, a PCB, conductive metal, electrically-conductive trace, etc.

The vias of the interconnect boards 212 provide electrical connection from the ground laminate of the interconnected board 212 (tapered line) to the ground laminate 224 of the network board 202. The ground level may be exactly in the middle between radiating elements 210. A signal at the network microstrip line 204 may be divided symmetrically and reach (through the microstrip line of the interconnected board 212) the radiating elements 210 at the two sides of the ground plane 224 at or at about the same time. At the ground level, the ground signal may be moved from the vias connection to the interconnect board microstrip ground (tapered section).

In exemplary embodiments, the feed from the network board 202 to the interconnected boards 212 may be constructed or configured in a way that is perfectly symmetric, such that the feed point is exactly at the center of the interconnecting vertical microstrip line of the interconnect boards 212. This symmetric feed results in same phase currents at the two dipole elements 210 above and below the network board 202. The same current phase in the radiating (dipole) elements 210 ensures low ripple in the azimuth plane radiation in these exemplary embodiments.

As shown in FIG. 27, each radiating board 206, 208 includes an array of four dipole radiating elements 210 spaced apart along (e.g., equally spaced apart, etc.) along a side of the board 206, 208. The dipole radiating elements 210 cover a portion of one side of the radiating boards 206, 208. The antenna assembly 200 thus includes four pairs of dipole radiating elements 210. The network board 202 is between each pair of dipole radiating elements 210, such that each pair includes a dipole radiating element along one side of the network board 202 and another dipole radiating element along the opposite side of the network board 202. The dipole radiating elements 210 may comprise any suitable material for radiating RF energy, such as, for example, PCB traces, electrically-conductive metal, etc. The radiating boards 206, 208 include slots 215 for receiving corresponding end portions of the interconnect boards 212.

As shown by FIG. 28, a slot or thru-hole 215 is located adjacent to each dipole radiating element 210 at the middle of each radiating dipole 210 between the first and second spaced-apart portions or legs 211 of the dipole radiating element 210, etc. The first and second spaced-apart portions or legs 211 of each dipole 210 are spaced apart by a slot or gap 213. The dipole legs or portions 211 are on opposite sides of the end portion of the interconnect board 212, which is received through the slot 215 in the board 206, 208.

FIG. 28 shows the unique shape of the dipole radiating element 210, which makes it suitable for high and low bands, e.g., 2.4 GHz band and 5 GHz band. The dipole radiating element 210 includes low band dipole branches 250 and high band dipole branches 254. The dipole branches 250 and 254 of one dipole leg or portion 211 are symmetrical with the corresponding dipole branches 250 and 254 of the other dipole leg or portion 211. The dipole branches are symmetrical to ensure that only co-polarized currents (at z-direction) contribute to the radiation fields and that the currents flow in the same direction (e.g., parallel to or toward the direction of polarization) on each side 211 of the dipole 210.

In this exemplary embodiment, each low band dipole branch 250 include a generally rectangular annular section 251 between a first generally linear or straight (solid rectangular) section 253 and a second generally linear or straight (solid rectangular) section 255. A third generally linear or straight (solid rectangular) section 257 is at the end of the low band dipole branch 250. The end section 257 is generally perpendicular to the second linear section 255 such that the sections 255 and 257 cooperative define a generally T-shape portion. The low band dipole branches 250 thus have a non-linear shape to reduce the overall footprint or physical area required for the low band dipole branches 250 while also increasing their electrical length. Accordingly, the low band dipole branches 250 are configured to be physically small but electrically large to resonate within the 2.4 GHz band.

Also in this exemplary embodiment, the high band dipole branches 254 are generally rectangular in shape with a notch or stepped portion 259 at a corner of the rectangular. The high band dipole branches 254 extend along opposite sides of the first section 251 of the low band dipole branch 250. The high band dipole branches 254 are spaced apart from the low band dipole branch 250 by a spaced distance 259 (e.g., L-shaped slots, etc.).

For each dipole leg or portion 211, there is generally linear or straight section 263 that is disposed between and/or connects the high band dipole branches 254 to the first section 253 of the low band dipole branch 250. With the low and high dipole branches 250 and 254, the dipole radiating element 210 thus comprises a dual band dipole that is operable at the low and high bands. The 0 to 80 millimeter (mm) scale and 0 to 20 mm scale shown at the bottom of FIGS. 27 and 28, respectively, are for purpose of illustration only, as other embodiments may include larger or smaller antenna components.

As shown in FIG. 29, the electrically-conductive laminate 224 (broadly, ground plane) is along the bottom of the network board 202. The electrically-conductive laminate 224 may act as a reflector for each dipole 210 and may be located approximately an equal distance from each dipole 210. The dipole radiating elements 210 may radiate RF energy omnidirectionally in the Z-Y plane during operation of the antenna assembly 200. The 0 to 60 millimeter (mm) scale shown at the bottom of FIG. 29 is for purpose of illustration only, as other embodiments may include larger or smaller antenna components.

The microstrip lines of the network board 202 and interconnect boards 212 may be connected in a similar way (e.g., using a via, etc.) to that shown in FIG. 10 for connecting the microstrip lines of the network board 102 and interconnect boards 112. The feeding structure from the network board's microstrip lines 204 to the microstrip lines of the interconnect board 212 may ensure or provide symmetrical feeding of each dipole 210 from the network's microstrip lines 204.

In this exemplary embodiment, the antenna assembly 200 includes a four dual band dipole array along each side of the network board 202. The network board 202 is also operable as a reflector. Each dual band dipole 210 is operable such that RF currents for both the high band (e.g., 5 GHz band, etc.) and the low band (e.g., 2.4 GHz band, etc.) are co-located on each dual band dipole 210. Each dual band dipole 210 is operable as a single dipole element simultaneously for the 2.4 GHz band and the 5 GHz band. In this example, each array of four dual band dipoles 210 is operable simultaneously and co-locates a 4 dipole-like 2.4 GHz array with a 4 dipole-like 5 GHz array. For each array, the four dual band dipoles 210 array may be co-located very close to each other within the array. For example, the dual band dipoles 210 may be less than one wavelength apart at high band (e.g., one wavelength apart for the 5 GHz band, one wavelength apart at a frequency of 5.9 GHz, spaced apart by about 2 inches (about 5.08 centimeters) or less, etc.), Due to the close spacing of the dipoles 210 (e.g., about 2 inches apart, etc.), the sidelobes are relatively small and may thus help prevent radiating power from going in unwanted directions. But the close spacing of the dipoles 210 may also limit the gain of the antenna assembly 200. Accordingly, the radiating elements 210 may be configured to be physically small to allow close positioning of the radiating elements 210 (e.g., spaced apart by about 2 inches or less, etc.). In turn, this may allow the antenna assembly 200 to have good symmetrical main beams at both low and high bands and no grading lobes at high band. The sidelobes at the elevation patterns may thus also be small relative to main beam. Accordingly, the antenna assembly 200 may thus provide the benefit of low sidelobes within limited real estate or with a compact size.

For the exemplary embodiment shown in FIG. 24, the antenna assembly 200 includes only four interconnecting boards 212 and only four dual band dipoles or radiating elements 210 along each radiating board 206, 208. This is significantly less than the conventional antenna shown in FIG. 13, which requires twelve interconnecting boards 12 and twelve different radiating elements 10 on each side. This conventional antenna includes an array 3 of four dipole radiating elements for the low band (2.4 GHz band) and another array 5 of eight dipole radiating elements for the high band (5 GHz band). The arrays 3, 5 are spaced apart from each other and do not use or rely upon the same radiating elements 10. In FIG. 13, the arrows indicate radiating currents at 2.4 GHz and 5 GHz, which are not co-located on any one of the radiating elements 10. Instead, FIG. 13 shows the radiating currents at 2.4 GHz and 5 GHz separated or isolated from each other as the low band radiating currents are located on or confined to the array 3 of four dipoles (on the right hand side of FIG. 13), whereas the high band radiating currents are located on or confined to the array 5 of eight dipoles (on the left hand side of FIG. 13).

With its twelve interconnect boards 12 and twelve radiating elements 10 on each side, the length of the conventional antenna is very large especially when configured to have omnidirectional patterns in the azimuth plane. For example, the conventional antenna may have a length of 27½ inches to 31½ inches (700 to 800 millimeters). The network board 2 is also very complex for this conventional antenna. For example, a special circuit or diplexer is required to combine the 2.4 GHz signals with the 5 GHz signals. The network board 2 takes up a lot of space because there are twelve total signals coming to the network board 2 that have to be combined. The network board 2 thus has to be relatively long, such that the antenna length is very large for the conventional antenna of FIG. 13 as compared to the antenna assembly 200 of FIG. 24, which may have a length of 8 inches of less.

FIGS. 30 through 33 provide analysis results measured for a physical prototype of the antenna assembly 200 including the radome 218 shown in FIGS. 24 through 26. These analysis results are provided only for purposes of illustration and not for purposes of limitation.

FIG. 30 is an exemplary line graph of voltage standing wave ratio (VSWR) versus frequency (MHz) measured for the physical prototype of the antenna assembly 200 including the radome 218. The VSWR may be lower because of a wide dipole shape that may allow approximately constant impedance versus frequency.

FIG. 31 is an exemplary line graph of peak gain in decibels relative to isotropic (dBi) versus frequency (MHz) measured for the physical prototype of the antenna assembly 200 including the radome 218. As shown, the measured radiating gain is averaging around 4 dBi at low band and around 7.5 dBi at high band.

FIG. 21 shows the pattern orientation and planes relative to a prototype antenna during radiation pattern testing. FIG. 32 illustrates radiation patterns (Azimuth Theta=90° Co-Planar, Elevation Phi=0° Co-Planar, and Elevation Phi=90° Co-Planar) measured for the physical prototype of the antenna assembly 200 including the radome 218 at a frequency of about 2450 MHz. FIG. 33 illustrates radiation patterns (Azimuth Theta=90° Co-Planar, Elevation Phi=0° Co-Planar, and Elevation Phi=90° Co-Planar) measured for the physical prototype of the antenna assembly 200 including the radome 218 at a frequency of about 5450 MHz. Generally, FIGS. 31 and 32 show that the example antenna assembly 200 may provide excellent azimuth radiation patterns with very little ripple in the horizon, and may provide clean elevation patterns with the beam steady at horizon. Accordingly, the antenna assembly 200 may thus provide the benefit of omnidirectional patterns with low ripple, which benefit may be obtained from the distinct structure in having a combination of network reflector and the array factor of dipoles on each side of network board.

Exemplary embodiments of the antenna assemblies are disclosed herein that may provide one or more of (but not necessarily any or all of) the following advantages. Exemplary antenna assemblies may provide a compact form, such as, for example, an antenna assembly (e.g., 100, etc.) with a length less than 15 inches (381 millimeters), an antenna assembly (e.g., 200, etc.) with a length less than 8 inches (203.2 millimeters), etc. Exemplary antenna assemblies may include only four dipole-like radiating elements on a first board and on a second board, and may include only four interconnecting boards. An exemplary embodiment of an antenna assembly may provide a high gain, such as, for example, between about 8 dBi and about 10 dBi, for at least two Wi-Fi frequency bands (e.g., 2.4 GHz Wi-Fi band and 5 GHz Wi-Fi band, etc.). Or, for example, an exemplary embodiment of an antenna assembly may have a medium gain (e.g., 4 to 7 dBi, etc.), such as a measured radiating gain averaging 4 dBi at low band (e.g., 2.4 GHz band, etc.) band and about 7.5 dBi at high band (e.g., 5 GHz band, etc.). An exemplary embodiment of an antenna assembly may provide low omnidirectional radiation ripple in the horizon for substantially all desirable operating frequencies. An exemplary embodiment of an antenna assembly may provide a low VSWR, such as, for example, less than about 1.5:1 for substantially all desirable operating frequencies. In an exemplary embodiment, the VSWR in the connector may be less than 2:1 at both the low band and high band simultaneously.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purposes of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna assembly comprising:

a first radiating board including one or more dipole radiating elements;

a second radiating board including one or more dipole radiating elements;

a network board between the first and second radiating boards such that the first and second radiating boards are respectively spaced apart from upper and lower surfaces of the network board and/or are parallel to the network board, the network board including a feed network and a ground plane; and one or more interconnect boards operable for providing an electrical connection between the feed network and the dipole radiating elements of the first and second radiating boards;

whereby the dipole radiating elements are operable simultaneously and co-locate radio frequency currents for a first frequency band and a second frequency band.

2. The antenna assembly of claim 1, wherein each said dipole radiating element is simultaneously operable for the first and second frequency bands, whereby radio frequency currents for the first frequency band and radio frequency currents for the second frequency band are co-located on each said dipole radiating element.

3. The antenna assembly of claim 1, wherein:

the one or more dipole radiating elements of the first radiating board comprise a first plurality of dipole radiating elements along the first radiating board; and the one or more dipole radiating elements of the second radiating board comprise a second plurality of dipole radiating elements along the second radiating board; and the one or more interconnect boards comprise a plurality of interconnect boards, each said interconnect board operable for providing an electrical connection between the feed network and a corresponding pair of the dipole radiating elements of the first and second radiating boards, whereby each said pair of the dipole radiating elements is electrically connected with the feed network by the corresponding interconnect board.

4. The antenna assembly of claim 1, further comprising a radome having a cylindrical shape, a radome cap coupled to a first end of the radome, and a connector at a second end of the radome and configured for connection with a coaxial cable, wherein the network board, first and second radiating boards, and interconnect boards are positioned within and enclosed in an internal space defined by the radome, the radome cap, and the connector.

5. The antenna assembly of claim 1, wherein:

the one or more dipole radiating elements of the first radiating board comprise four dipole radiating elements along the first radiating board; and the one or more dipole radiating elements of the second radiating board comprise four dipole radiating elements along the second radiating board;

whereby each said dipole radiating element is operable as a single dipole element for the first frequency band and as two dipole elements for the second frequency band, and/or whereby the dipole radiating elements are operable as a four dipole 2.4 GHz array co-located with an eight dipole 5 GHz array with both arrays using the same radiating elements.

6. The antenna assembly of claim 1, wherein the antenna assembly is omnidirectional in the horizon for the first frequency band from about 2.4 GHz to about 2.5 GHz and the second frequency band from about 5.15 GHz to about 5.9 GHz.

7. The antenna assembly of claim 1, wherein:

the one or more dipole radiating elements of the first radiating board comprise four dual band dipole radiating elements along the first radiating board; and the one or more dipole radiating elements of the second radiating board comprise four dual band dipole radiating elements along the second radiating board;

whereby the dipole radiating elements are operable as a four dipole 2.4 GHz array co-located with a four dipole 5 GHz array with both arrays using the same radiating elements.

8. The antenna assembly of claim 1, wherein:

the network board, the first and second radiating boards, and the interconnect boards are within a radome;

the network board is operable as a reflector for the antenna assembly; and the one or more interconnect boards are operable as a balun.

9. The antenna assembly of claim 1, wherein each said dipole radiating element includes:

a first portion having one or more dipole slots; and a second portion having one or more dipole slots and separated from the first portion by a spaced distance; and each said dipole radiating element is configured such that there are currents that flow in a same direction along each of the first and second portions for the first and second frequency bands and such that there are also slot currents that flow around the one or more dipole slots for the second frequency band.

10. The antenna assembly of claim 1, wherein the feed network is configured to be symmetric with a feed point centered relative to the one or more interconnect boards, whereby the symmetric feed results in same phase currents at each corresponding pair of the dipole radiating elements of the first and second radiating boards.

11. The antenna assembly of claim 1, wherein:

the feed network comprises one or more microstrip lines along a first side of the network board;

the ground plane comprises an electrically-conductive laminate along a second side of the network board;

the network board, the first and second radiating boards, and the interconnect boards are within an internal space defined by a radome having a cylindrical shape, a radome cap coupled to a first end of the radome, and a connector at a second end of the radome and configured for connection with a coaxial cable; and the antenna assembly further comprises a collar that provides a mechanical coupling between the connector and the radome, a sleeve coupled to the second end of the radome between the collar and the radome, a pad positioned on an end portion of the network board to help stabilize and hold the network board in place within the radome and/or inhibit vibrations, and choke that couples the connector to the network board and increases bandwidth of the antenna assembly.

12. An antenna assembly comprising:

a feed network;

a ground plane;

an array of radiating dipoles including:

a first plurality of radiating dipoles; and a second plurality of radiating dipoles spaced apart from the first plurality of radiating dipoles;

wherein the feed network and the ground plane are between the first and second pluralities of radiating dipoles such that the first and second plurality of radiating dipoles are respectively spaced apart from upper and lower sides of the ground plane and are parallel to the ground plane;

whereby the radiating dipoles are operable simultaneously and co-locate radio frequency currents for a first frequency band and a second frequency band.

13. The antenna assembly of claim 12, wherein each said radiating dipole is simultaneously operable for the first and second frequency bands, whereby radio frequency currents for the first frequency band and radio frequency currents for the second frequency band are co-located on each said radiating dipole.

14. The antenna assembly of claim 12, further comprising:

a first radiating board including the first plurality of radiating dipoles;

a second radiating board including the second plurality of radiating dipoles;

a network board between the first and second radiating boards such that the first and second radiating boards are respectively spaced apart from upper and lower surfaces of the network board and/or are parallel to the network board, the network board including the feed network and the ground plane;

a plurality of interconnect boards, each said interconnect board operable for providing an electrical connection between the feed network and a corresponding pair of the radiating dipoles of the first and second radiating boards, whereby each said pair of the dipole radiating elements is electrically connected with the feed network by the corresponding interconnect board.

15. The antenna assembly of claim 14, further comprising:

a radome having a cylindrical shape;

a radome cap coupled to a first end of the radome; and a connector at a second end of the radome and configured for connection with a coaxial cable;

wherein the network board, first and second radiating boards, and interconnect boards are positioned within and enclosed in an internal space defined by the radome, the radome cap, and the connector.

16. The antenna assembly of claim 12, wherein:

the radiating dipoles are operable as a four dipole 2.4 GHz array co-located with an eight dipole 5 GHz array with both arrays using the same radiating dipoles; and/or each said radiating dipole is operable as a single dipole element for the first frequency band and as two dipole elements for the second frequency band.

17. The antenna assembly of claim 12, wherein the radiating dipoles are operable as a four dipole 2.4 GHz array co-located with a four dipole 5 GHz array with both arrays using the same radiating dipoles.

18. The antenna assembly of claim 12, wherein:

each said radiating dipole includes a first portion having one or more dipole slots, and a second portion having one or more dipole slots and separated from the first portion by a spaced distance; and each said radiating dipole is configured such that there are currents that flow in a same direction along each of the first and second portions for the first and second frequency bands and such that there are also slot currents that flow around the one or more dipole slots for the second frequency band.

19. An antenna assembly comprising:

a feed network;

a ground plane;

first and second arrays of radiating dipoles spaced apart from opposite upper and lower sides, respectively, of the feed network and the ground plane; and a plurality of interconnect boards, each said interconnect board operable for providing an electrical connection between the feed network and a corresponding pair of the radiating dipoles such that each said pair of the radiating dipoles is electrically connected with the feed network by the corresponding interconnect board;

whereby the radiating dipoles are operable within at least a frequency band from about 2.4 GHz to about 2.5 GHz and a second frequency band from about 5.15 GHz to about 5.9 GHz.

20. The antenna assembly of claim 19, wherein the radiating dipoles are operable simultaneously and co-locate radio frequency currents for the first frequency band and radiating frequency currents for the second frequency band on the radiating dipoles.

21. The antenna assembly of claim 19, wherein:

the radiating dipoles are operable as a four dipole 2.4 GHz array co-located with an eight dipole 5 GHz array with both arrays using the same radiating dipoles; and/or each said radiating dipole is operable as a single dipole element for the first frequency band and as two dipole elements for the second frequency band.

22. The antenna assembly of claim 19, wherein the radiating dipoles are operable as a four dipole 2.4 GHz array co-located with a four dipole 5 GHz array with both arrays using the same radiating dipoles, and wherein:

each said radiating dipole includes two dipole legs, each said dipole leg including low and high band dipole branches that are symmetric with the low and high band dipole branches of the other dipole leg;

the low band dipole branch including a generally rectangular annular section between a first generally linear section and a second generally linear section, and a third generally linear section at the end of the low band dipole branch that is generally perpendicular to the second generally linear section; and the high band dipole branches have generally rectangular shapes with a notch or stepped portion at a corner of the generally rectangular shape, the high band dipole branches extend along opposite sides of the first generally linear section of the low band dipole branch, the high band dipole branches are spaced apart from the low band dipole branch; and each said dipole leg includes a generally linear section that is disposed between and/or connects the high band dipole branches to the first generally linear section of the low band dipole branch.

* * * * *